US011091281B2

(12) United States Patent
Mannion et al.

(10) Patent No.: US 11,091,281 B2
(45) Date of Patent: Aug. 17, 2021

(54) FILM TO FILM PACKAGING SOLUTION FOR STERILIZED NONWOVEN FABRIC PRODUCTS

(71) Applicant: O&M Halyard, Inc., Mechanicsville, VA (US)

(72) Inventors: Gavin H. Mannion, Atlanta, GA (US); Phillip A. Schorr, Cumming, GA (US); Mark R. Ellswood, Alpharetta, GA (US); Stefan L. Blum, Canton, GA (US); Jacob J. Fantuz, Hixon, TN (US); Aaron D. Smith, Alpharetta, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 134 days.

(21) Appl. No.: 16/343,864

(22) PCT Filed: Nov. 13, 2017

(86) PCT No.: PCT/US2017/061231

§ 371 (c)(1),
(2) Date: Apr. 22, 2019

(87) PCT Pub. No.: WO2018/093700

PCT Pub. Date: May 24, 2018

(65) Prior Publication Data

US 2019/0263548 A1 Aug. 29, 2019

Related U.S. Application Data

(60) Provisional application No. 62/422,806, filed on Nov. 16, 2016.

(51) Int. Cl.
*B65B 11/52* (2006.01)
*B65B 25/14* (2006.01)
(Continued)

(52) U.S. Cl.
CPC ..... *B65B 11/52* (2013.01); *B65B 9/045* (2013.01); *B65B 11/50* (2013.01); *B65B 25/145* (2013.01); *B65B 31/024* (2013.01); *B65B 55/16* (2013.01)

(58) Field of Classification Search
None
See application file for complete search history.

(56) References Cited

U.S. PATENT DOCUMENTS 2,790,284 A * 4/1957 Hultkrans ..... B65B 31/024 53/405
4,041,203 A 8/1977 Brock et al.
(Continued)

FOREIGN PATENT DOCUMENTS

WO WO 2011/090942 A1 7/2011
WO WO-2015141671 A1 * 9/2015 ..... B65D 85/62

OTHER PUBLICATIONS

International Search Report and Written Opinion for PCT/US2017/061231, 13 pages.

*Primary Examiner* — Hemant Desai
*Assistant Examiner* — Tanzim Imam
(74) *Attorney, Agent, or Firm* — Dority & Manning, P.A.

(57) ABSTRACT

A product and method for reducing tensile strength loss associated with sterilization of the product by ionizing radiation sterilization methods is provided. The method includes providing a package that includes a layer having an oxygen transmission rate equal to or less than about 10 cubic centimeters of oxygen per 100 inches squared per 24 hours; providing a product in the package's interior; applying a vacuum to the exterior of the package in a controlled atmosphere until a vacuum pressure equal to or less than about 250 millibars is achieved; flushing the interior of the package with an inert gas until an inert gas flush pressure equal to or less than about 750 millibars is achieved; sealing the package; releasing the vacuum applied in the controlled atmosphere; and sterilizing the package/product with radiation. The resulting product has a reduction in its tensile strength of less than about 18.5% after sterilization.

21 Claims, 15 Drawing Sheets

(51) Int. Cl.

| | |
|---|---|
| ***B65B 31/02*** | (2006.01) |
| ***B65B 55/16*** | (2006.01) |
| ***B65B 9/04*** | (2006.01) |
| ***B65B 11/50*** | (2006.01) |

(56) References Cited

U.S. PATENT DOCUMENTS

| | | | | |
|---|---|---|---|---|
| 4,340,563 | A | 7/1982 | Appel et al. | |
| 5,041,483 | A | 8/1991 | Burch | |
| 5,392,590 | A * | 2/1995 | Ambrose | A61L 2/08 53/425 |
| 5,485,496 | A * | 1/1996 | Lee | A61L 2/08 378/51 |
| 5,881,534 | A | 3/1999 | Ahlqvist et al. | |
| 6,933,026 | B2 | 8/2005 | Mauze et al. | |
| 2007/0084144 | A1* | 4/2007 | Labrecque | A61L 2/26 53/425 |
| 2009/0084695 | A1* | 4/2009 | Vellutato, Jr. | B65D 85/18 206/278 |
| 2011/0203227 | A1* | 8/2011 | Chen | B65B 5/04 53/432 |
| 2012/0012496 | A1* | 1/2012 | Schorr | B65D 81/2023 206/525 |
| 2012/0124943 | A1* | 5/2012 | Nakamura | B65B 7/02 53/425 |

* cited by examiner

FILM TO FILM PACKAGING SOLUTION FOR STERILIZED NONWOVEN FABRIC PRODUCTS

RELATED APPLICATIONS

The present application is the national stage entry of International Patent Application No. PCT/US2017/061231 having a filing date of Nov. 13, 2017, which claims priority to U.S. Provisional Patent Application Ser. No. 62/422,806, filed on Nov. 16, 2016, both of which are incorporated herein in theft entirety by reference thereto.

FIELD OF THE INVENTION

The invention pertains to vacuum packaged products and methods of making the same, and more particularly to vacuum packaged nonwoven products and methods that reduce or eliminate the undesirable side effects associated with the sterilization thereof.

BACKGROUND OF THE INVENTION

Various fields of use require the use of sterilized polyolefin-based fabrics, equipment, and tools. For example, it is well known that the operating environments of medical personnel, dental personnel, chemical research personnel, biotech personnel, and other like areas utilize polyolefin-based products that have been sterilized prior to use (e.g., drapes, gowns, masks, etc.).

Currently, ethylene oxide has been used to sterilize polyolefin-based products such as medical fabrics that are used as surgical gowns and drapes. However, the potentially hazardous nature and high cost of ethylene oxide sterilization have caused the medical community to consider different sterilization methods. One effective method of sterilization has been the use of gamma irradiation and other types of ionizing radiation, such as electron beam irradiation or x-ray irradiation. Although sterilization by gamma irradiation and other methods has been successful for polyolefin-based products and equipment, there remain at least two very undesirable side effects caused by the irradiation process. The first undesirable side effect has been a resulting odor that renders the gamma irradiated polyolefin-based product undesirable for many uses. The second undesirable side effect has been a noticeably decreased strength of the irradiated polyolefin-based products. In fact, the irradiation process has been known to decrease a polyolefin-based product's tear strength by as much as 65% of its non-irradiated tear strength.

It has been shown that the cause for the undesirable odor and the loss in polyolefin-based product strength is a free radical process that occurs when the polyolefins of the product are exposed to gamma radiation in the presence of oxygen. In polyolefin-based products, this process essentially breaks chemical bonds that hold a polyolefin chain together and creates free radicals. This breaking of the polyolefin backbone causes the polyolefin to lose strength proportional to the radiation dosage. The formed radicals are able to recombine with the oxygen in the air, producing short chain acids, oxygenated compounds, such that they become trapped in the product. Butyric acid, one of the acids formed, is a primary suspect in causing the odor.

Although earlier efforts and attempts to eliminate these two undesirable side effects include methods that marginally reduce the odor associated with the gamma irradiation of polyolefin-based products, none has adequately reduced the odor or minimized the reduction in tear strength resulting from the irradiation treatment.

A need therefore exists for a product and method for further minimizing or eliminating the odor that is associated with the gamma irradiation of polyolefin-based products.

Another need exists for a product and method that not only reduces the odor, but also minimizes any decrease in the tensile strength of the polyolefin-based product that is due to the gamma irradiation.

A need also exists for a product and method where the volume of the packaged product is reduced, resulting in the packaged product occupying less space in storage and shipping, thus lowering costs.

SUMMARY OF THE INVENTION

In accordance with one embodiment of the present invention, a combination of a product and a film-to-film package is contemplated. The product is vacuum packaged in the film-to-film package. The film-to-film package has an interior and comprises a layer having an oxygen transmission rate equal to or less than about 10 cubic centimeters of oxygen per 100 inches squared per 24 hours. Further, the product is located in the interior of the film-to-film package, and air is removed from the interior of the film-to-film package by applying a vacuum pressure equal to or less than about 250 millibars to the exterior of the film-to-film package and then flushing the interior of the film-to-film package with an inert gas until the interior of the film-to-film package reaches an inert gas flush pressure equal to or less than about 750 millibars. In addition, the film-to-film package and the product are sterilized by ionizing radiation, and the product exhibits a reduction in its tensile strength that is equal to or less than about 18.5% after sterilization.

In one embodiment, the film-to-film package can be thermoformed.

In one particular embodiment, the ionizing radiation can be gamma irradiation, electron beam irradiation, or x-ray irradiation.

In another embodiment, the layer can include ethylene vinyl alcohol or nylon.

In one more embodiment, the product can include a nonwoven polyolefin material.

In still another embodiment, the vacuum pressure can be between about 15 millibars and about 50 millibars, and the inert gas flush pressure can be between about 50 millibars and about 150 millibars. In such an embodiment, the reduction in tensile strength in the machine direction can be equal to or less than about 10% after sterilization, while the reduction in tensile strength in the cross-machine direction can be equal to or less than about 18% after sterilization.

In yet another embodiment, the vacuum pressure can be between about 75 millibars and about 125 millibars, and the inert gas flush pressure can be between about 400 millibars and about 600 millibars. In such an embodiment, the reduction in tensile strength in the machine direction can be equal to or less than about 15% after sterilization, while the reduction in tensile strength in the cross-machine direction can be equal to or less than about 18.5% after sterilization.

In another embodiment, the layer can have an oxygen transmission rate equal to or less than about 5.0 cubic centimeters of oxygen per 100 inches squared per 24 hours. For instance, the layer can have an oxygen transmission rate between about 0.001 cubic centimeters of oxygen per 100 inches squared per 24 hours and about 2.0 cubic centimeters of oxygen per 100 inches squared per 24 hours.

In one more embodiment, the inert gas can include nitrogen, argon, or a combination thereof.

In still another embodiment, the film-to-film package can occupy less volume than a package not treated with a vacuum and an inert gas flush. For instance, the combination can have a density that is at least 10 percent greater than an identical combination not treated with a vacuum and an inert gas flush. In addition, the combination can have a pre-determined shape and/or a pre-determined stiffness. For example, the pre-determined shape can be substantially planar, and the pre-determined stiffness can be at least 10 percent greater than an identical combination not treated with a vacuum and an inert gas flush.

In accordance with another embodiment of the present invention, a method of packaging a product in a package is contemplated. The method includes the steps of providing a film-to-film package comprising a layer having an oxygen transmission rate equal to or less than about 10 cubic centimeters of oxygen per 100 inches squared per 24 hours, and having an interior and an exterior; providing a product in the interior of the film-to-film package; applying a vacuum to the exterior of the package in a controlled atmosphere until a vacuum pressure equal to or less than about 250 millibars is achieved; flushing the interior of the film-to-film package with an inert gas until an inert gas flush pressure equal to or less than about 750 millibars is achieved; sealing the film-to-film package; releasing the vacuum applied to the exterior of the package in the controlled atmosphere; and sterilizing the package and product with ionizing radiation resulting in the product having a reduction in its tensile strength that is equal to or less than about 18.5% after sterilization.

In one embodiment, the film-to-film package can be thermoformed.

In one particular embodiment, the ionizing radiation can be gamma irradiation, electron beam irradiation, or x-ray irradiation.

In another embodiment, the layer can include ethylene vinyl alcohol or nylon.

In one more embodiment, the product can include a nonwoven polyolefin material.

In still another embodiment, the vacuum pressure can be between about 15 millibars and about 50 millibars, and the inert gas flush pressure can be between about 50 millibars and about 150 millibars. In such an embodiment, the reduction in tensile strength in the machine direction can be equal to or less than about 10% after sterilization, while the reduction in tensile strength in the cross-machine direction can be equal to or less than about 18% after sterilization.

In yet another embodiment, the vacuum pressure can be between about 75 millibars and about 125 millibars, and the inert gas flush pressure can between about 50 millibars and about 150 millibars. In such an embodiment, the reduction in tensile strength in the machine direction can be equal to or less than about 15% after sterilization, while the reduction in tensile strength in the cross-machine direction can be equal to or less than about 18.5% after sterilization.

In another embodiment, the layer can have an oxygen transmission rate equal to or less than about 5.0 cubic centimeters of oxygen per 100 inches squared per 24 hours. For instance, the layer can have an oxygen transmission rate between about 0.001 cubic centimeters of oxygen per 100 inches squared per 24 hours and about 2.0 cubic centimeters of oxygen per 100 inches squared per 24 hours.

In one more embodiment, the inert gas can include nitrogen, argon, or a combination thereof.

In still another embodiment, the film-to-film package can occupy less volume than a package not treated with a vacuum and an inert gas flush. For instance, the step of releasing the vacuum applied to the exterior of the package in the controlled atmosphere can generate a combination of package and product having a density that is at least 10 percent greater than an identical combination not treated with a vacuum and an inert gas flush.

In one particular embodiment, the step of releasing the vacuum applied to the exterior of the package can generate a combination having a pre-determined shape and/or a pre-determined stiffness. For example, the pre-determined shape can be substantially planar, and the pre-determined stiffness can be at least 10 percent greater than an identical combination not treated with a vacuum and an inert gas flush.

In accordance with another embodiment of the present invention, a shipping system comprising a shipping container and a plurality of combinations of a product and a package as described herein is contemplated.

In still another embodiment, a dispensing system comprising: a dispensing container and a plurality of combinations of a product and a package as described herein is contemplated.

In yet another embodiment, a stack comprising two or more of a combination of a product and a package as described herein is contemplated.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
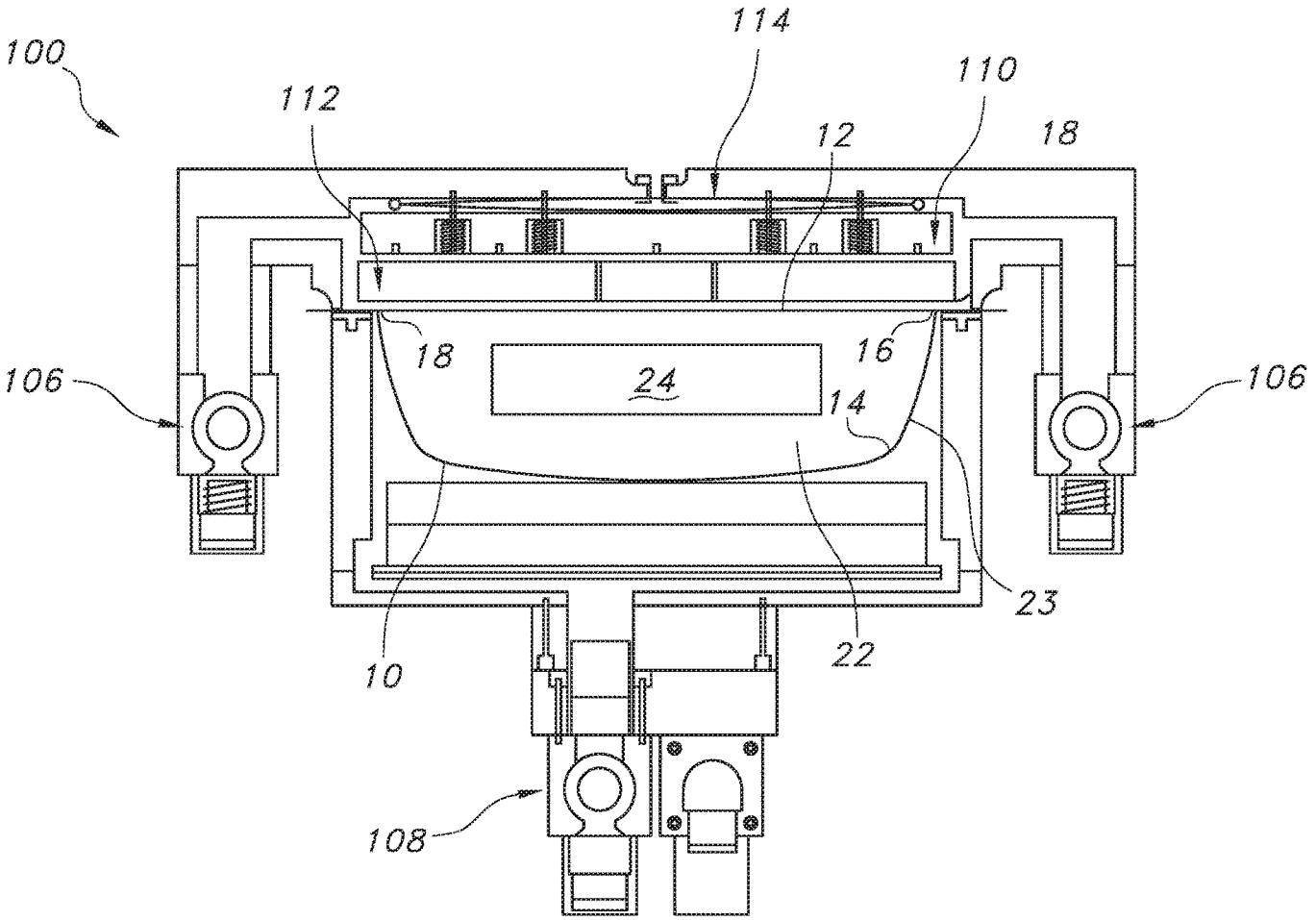
FIG. 1 is a cross-sectional view of a packaging apparatus used in the method of sealing a product inside a package according to one embodiment of the present invention after the package has been sealed.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

The present invention pertains to a nonwoven-based product. In one particular embodiment, the nonwoven-based product can be a material that includes a polyolefin. Nonwoven materials are materials that are formed without the aid of a textile weaving or knitting process such that it has a structure of individual fibers or threads that are interlaid, but not in any identifiable, repeating pattern. Nonwoven materials have been, in the past, formed by a variety of processes such as, for example, meltblowing processes, spunbonding processes, and bonded carded web processes. The materials of the present invention are generally selected from the polyolefin family. More specifically, the polyolefins may either be homopolymers or copolymers. The preferred homopolymer is polypropylene, and the preferred copolymer is a propylene/ethylene copolymer. The amount of propylene in the copolymer may range from 90% to 100%, and the amount of ethylene in the copolymer may range from 0 to 10%. It should be appreciated that as the amount of ethylene is increased, the flexibility of the material being produced will also be increased. Therefore, the preferred copolymer is 97% propylene and 3% ethylene. Methods for making polyolefin-based fabrics are well known in the art, see for example U.S. Pat. Nos. 4,041,203 and 4,340,563, which are incorporated by reference herein. In one particular embodiment, the polyolefin-based fabric is a spunbond-meltblown-spunbond (SMS) fabric, although it is to be understood that other types of fabrics can be utilized as known in the art.

The weight of the produced material for use in the product, represented in ounces per square yard, is normally determined by the intended use thereof. For example, if the material is to be used as a vehicle cover, the weight of the material should generally be in the range of 7.20 ounces per square yard (osy). If the material is to be used as a diaper liner, the weight of the material should generally be in the range from 0.3 ounces per square yard to 0.8 ounces per square yard. For surgical gowns, the material weight should range from 0.8 ounces per square yard to 3.0 ounces per square yard. A preferred polyolefin-based material for the product of the present invention is a nonwoven polypropylene spunbond/meltblown/spunbond (SMS) material having a basis weight of about 128 osy; another preferred basis weight is about 1.8 osy.

A gamma stabilizer, such as a benzoate ester, may be incorporated into the polyolefin prior to polyolefin extrusion. In the past, it has generally been believed that a gamma stabilizer must be added to the polyolefin in order to stabilize the polyolefin for the gamma irradiation process. This step was taken in an effort to minimize polyolefin strength loss and decrease odors. However, it is known that the use of a gamma stabilizer is not necessary in order to minimize polyolefin strength loss and odor. The present invention has been found to minimize strength loss in polypropylene without a gamma stabilizer. Also, it has been determined that the gamma stabilizer is not needed to reduce the odor associated with the gamma irradiation process. Nevertheless, a gamma stabilizer suitable for intended use herein and known to those of ordinary skill in the art may be incorporated into the polyolefin prior to extrusion.

It is known that when a polyolefin-based product such as the nonwoven material as described above is sterilized via irradiation, such as via gamma, electron-beam, or x-ray irradiation, or any other type of ionizing radiation, some of the bonds in the polyolefin chains are broken and combine with available oxygen, which leads to more chain scission, thereby weakening the product. For instance, when the product of the present invention is irradiated, some of the polyolefin chains are broken. However, there is little or no oxygen to combine with the bonding sites in the broken polyolefin chains due to various features of the packaging in which the product is contained and which are discussed in more detail below. Without intending to be limited by any particular theory, it is believed that the available bonding sites in the polyolefin chains are therefore free to recombine with one another instead of with oxygen in the package such that the majority of the tensile strength of the irradiated product is maintained. The minimization of the potential for the formation of oxygenated compounds, such as short-chain organic acids, with consequent reduction or elimination of odors associated therewith, also comprises a feature of the present invention, as do products which exhibit such characteristics. Other features of the present invention will be discussed in more detail below.

Generally speaking, the present invention is directed to a combination of a product and a thermoformed film-to-film package and a method of forming thereof in to improve the various properties of the product (e.g., reduced tensile strength loss, reduced odor, reduced volume for shipping/storage, ability for package to serve as a breach indicator, reduced processing time during manufacturing, etc.). The product is vacuum packaged in the thermoformed film-to-film package. The thermoformed film-to-film package has an interior and exterior and comprises a layer having an oxygen transmission rate equal to or less than about 10 cubic centimeters of oxygen per 100 inches squared per 24 hours. Further, the product is located in the interior of the thermoformed film-to-film package. Air is removed from the interior of the thermoformed film-to-film package by applying a vacuum pressure equal to or less than about 250 millibars to the exterior of the thermoformed film-to-film package and then flushing the interior of the thermoformed film-to-film package with an inert gas until the interior of the thermoformed film-to-film package reaches an inert gas flush pressure equal to or less than about 750 millibars, and the thermoformed film-to-film package and the product are sterilized by ionizing radiation. Further, the product exhibits a reduction in its tensile strength that is equal to or less than about 18.5% after sterilization.

For instance, when the vacuum pressure initially pulled against the exterior of the thermoformed film-to-film package is between about 15 millibars and 50 millibars and the inert gas flush pressure is between about 50 millibars and about 150 millibars, the reduction in tensile strength in the machine direction is equal to or less than about 10%, such was equal to or less than about 9.9%, such as equal to or less than about 9.8% after sterilization, while the reduction in tensile strength in the cross-machine direction can be equal to or less than about 18%, such as equal to or less than 17.75%, such as equal to or less than about 17.5% after sterilization. Further, when the vacuum pressure initially pulled against the exterior of the thermoformed film-to-film package is between about 75 millibars and 125 millibars and the inert gas flush pressure is between about 400 millibars and about 600 millibars, the reduction in tensile strength in the machine direction can be equal to or less than about 13.5%, such was equal to or less than about 13.25%, such as equal to or less than about 13% after sterilization, while the reduction in tensile strength in the cross-machine direction is equal to or less than about 18.75%, such as equal to or less than 18.5%, such as equal to or less than about 18.25% after sterilization.

It should be understood that although the package describe throughout is described as being a thermoformed film-to-film package, the present invention also contemplates a package that is not thermoformed. For instance, the package can be a film-to-film package that is sealed on three sides and has one side that is unsealed, where the product is inserted into the interior of the package via the unsealed end, after which a vacuum is applied and an inert gas flush is carried out in accordance with the methods described herein.

In order to form a combination of a package and nonwoven product contained therein, where the product exhibits minimal reduction in its tensile strength after sterilization by ionizing radiation, the present inventors have found that utilizing a thermoforming process in combination with a vacuum and an inert gas flush results in a product exhibiting improved properties. The use of the inert gas can also reduce the vacuum cycle time required for packaging the product, resulting in a more efficient and economical process. The package can be a film-to-film package that is thermoformed using, for example, a thermoforming packaging machine available from MULTIVAC® Sepp Haggenmüller GmbH & Co KG (Germany), such as the MULTIVAC® R 245 or the MULTIVAC® R 535 or any other suitable thermoforming packaging machine. With such machines, a package can be formed from rolls of packaging film, where the product to be vacuum packaged is loaded into thermoformed pocket formed by an outer member (e.g., film), after which another outer member (e.g., film) is placed on top of the product. Then, the top outer member is sealed under a vacuum, resulting in a vacuum packaged product. By utilizing a film-to-film package as described above, the use of paper-to-film sterilization pouches can be avoided, where the paper can tear easily, resulting in breach of sterility and an overall product that is bulky and takes up significant space.

Turning now to FIGS. 1-9, a method of packaging a product in a film-to-film package using a thermoforming packaging machine such as the machine generally described above is shown. First, FIG. 1 generally shows a cross sectional view of a thermoforming packaging machine 100 used in the method of sealing a product 24 contained inside an interior 22 of a package 10 formed from an outer member 12 and an outer member 14 according to one embodiment of the present invention after the package 10 has been sealed at seal lines 16 and 18. The packaging machine 100 includes a vacuum and ventilation die top 106, a vacuum and ventilation die bottom 108, a pressure plate 110, a sealing plate 112, and a sealing diaphragm 114. The package 10 should be a generally oxygen impermeable package in order to reduce the tensile strength loss of the product after sterilization and minimize the odor caused by oxygen free radicals after sterilization. By "oxygen impermeable" it is meant that the material of construction exhibits a high barrier to oxygen transmission. For instance, at least one layer of the package can be a film having an oxygen transmission rate equal to or less than about 10 cubic centimeters of oxygen per 100 inches squared per 24 hours, such as equal to or less than about 7.5 cubic centimeters of oxygen per 100 inches squared per 24 hours, such as equal to or less than about 5 cubic centimeters of oxygen per 100 inches squared per 24 hours, such as equal to or less than about 2.5 cubic centimeters of oxygen per 100 inches squared per 24 hours. For instance, at least one layer of the package can be film can have an oxygen transmission rate ranging from about 0.001 cubic centimeters of oxygen per 100 inches squared per 24 hours to about 2 cubic centimeters of oxygen per 100 inches squared per 24 hours.

Figure 2:
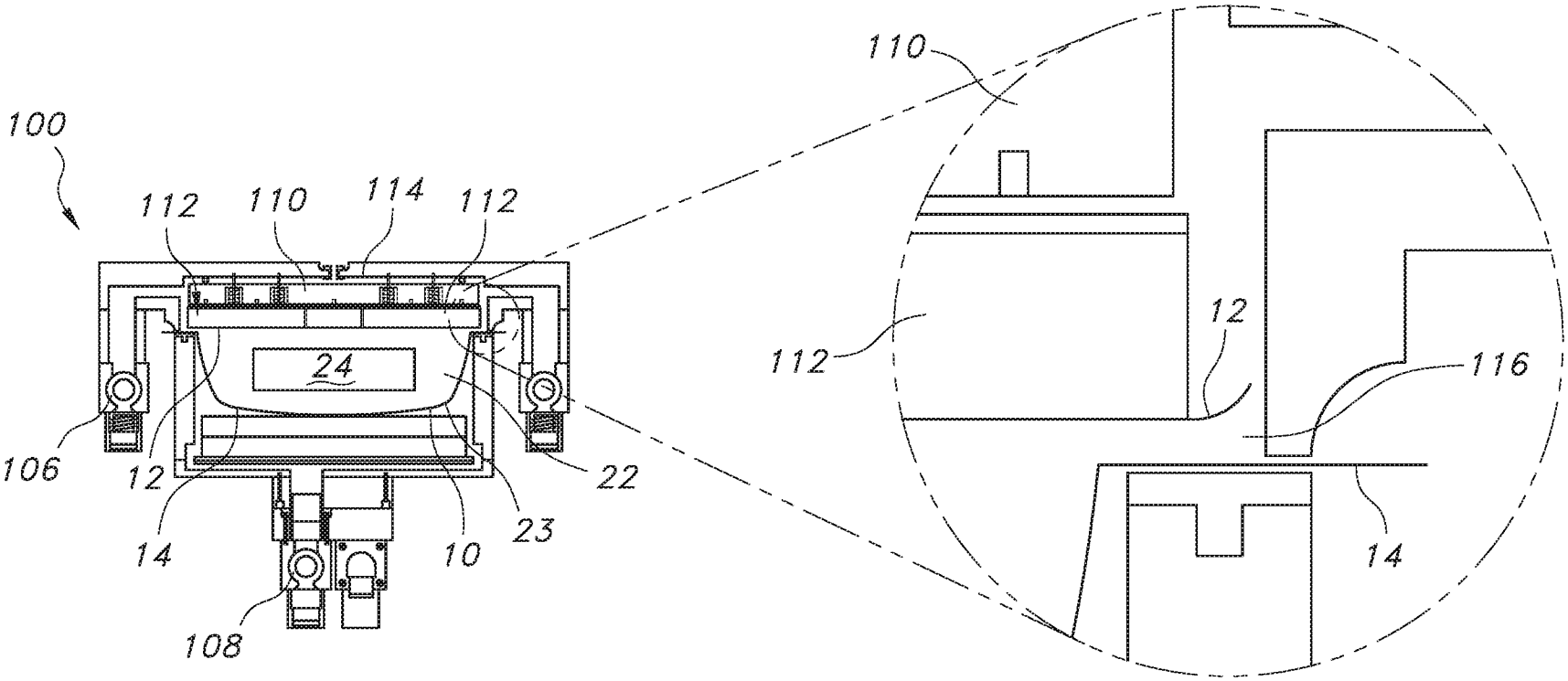
FIG. 2 is a cross-sectional view of a packaging apparatus used in the method of sealing a product inside a package according to one embodiment of the present invention, including a zoomed in view, before the package has been sealed and where a chamber is formed for pulling a vacuum and carrying out an inert gas flush.

Next, FIG. 2 shows a cross-sectional view of the thermo-packaging machine 100 of FIG. 1 before the package 10 has been sealed, as shown in the zoomed in section of FIG. 2 where outer member 12 and outer member 14 are not in contact with each other and where a product 24 has been placed inside the package 10, resting on the lower outer member 14, after which the upper outer member 12 is placed over the product 24. Such a configuration enables the formation of a chamber 116 and for pulling a vacuum and carrying out an inert gas flush. It is to be understood that the product 23 can also be pre-treated with an inert gas flush in order to ensure that the product 24 is partially aseptic before packaging the product 24, which can lower the initial bioburden level of the product 24, which, in turn, can allow for the reduction in the intensity of sterilization exposure needed to adequately sterilized the product. Such a pre-treatment step can thus reduce sterilization time and limit the reduction in tensile strength due to exposure to ionizing radiation.

Figure 3:
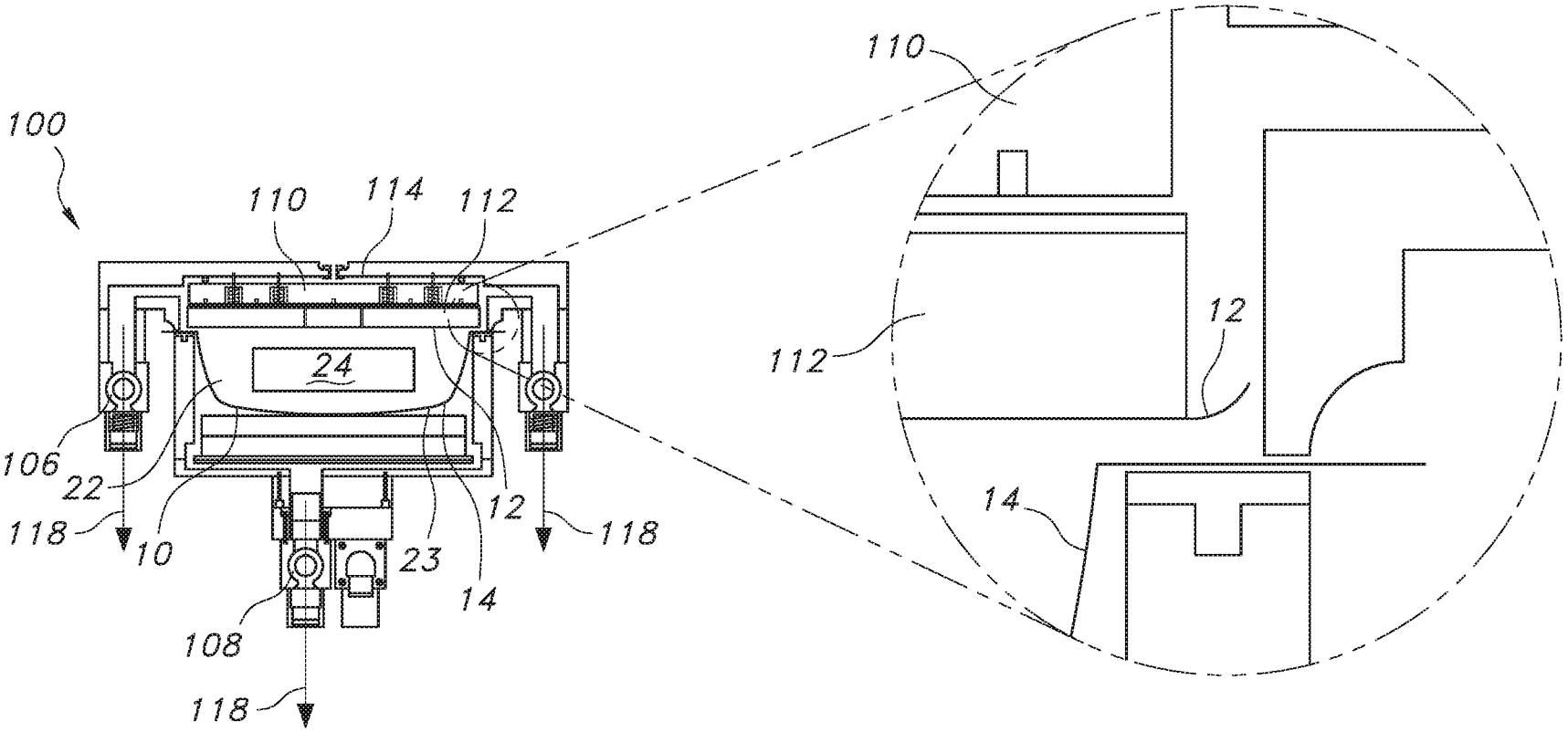
FIG. 3 is a cross-sectional view of a packaging apparatus used in the method of sealing a product inside a package according to one embodiment of the present invention, including a zoomed in view, before the package has been sealed and where a vacuum is pulled against the exterior of the package.

Next, as shown in FIG. 3, a vacuum 118 can then be pulled. As shown in the zoomed in section of FIG. 3, the vacuum 118 is pulled before the outer members 12 and 14 have been sealed together, and the vacuum 118 is pulled against the exterior 23 of the package 10 to facilitate removal or evacuation of air (e.g., oxygen) from the interior 22 of the package 10. As a result, the interior 22 of the package 10 can have a vacuum therein at a pressure equal to or less than about 250 millibars, such as equal to or less than about 200 millibars, such as equal to or less than about 150 millibars. In one embodiment, referred to as a medium level of vacuum, the interior 22 of the package 10 can have a vacuum therein at a pressure ranging from about 75 millibars to about 125 millibars, such as about 100 millibars. In another embodiment, referred to as a high level of vacuum, the interior 22 of the package 10 can have a vacuum therein at a pressure ranging from about 15 millibars to about 50 millibars, such as about 20 millibars.

Figure 4:
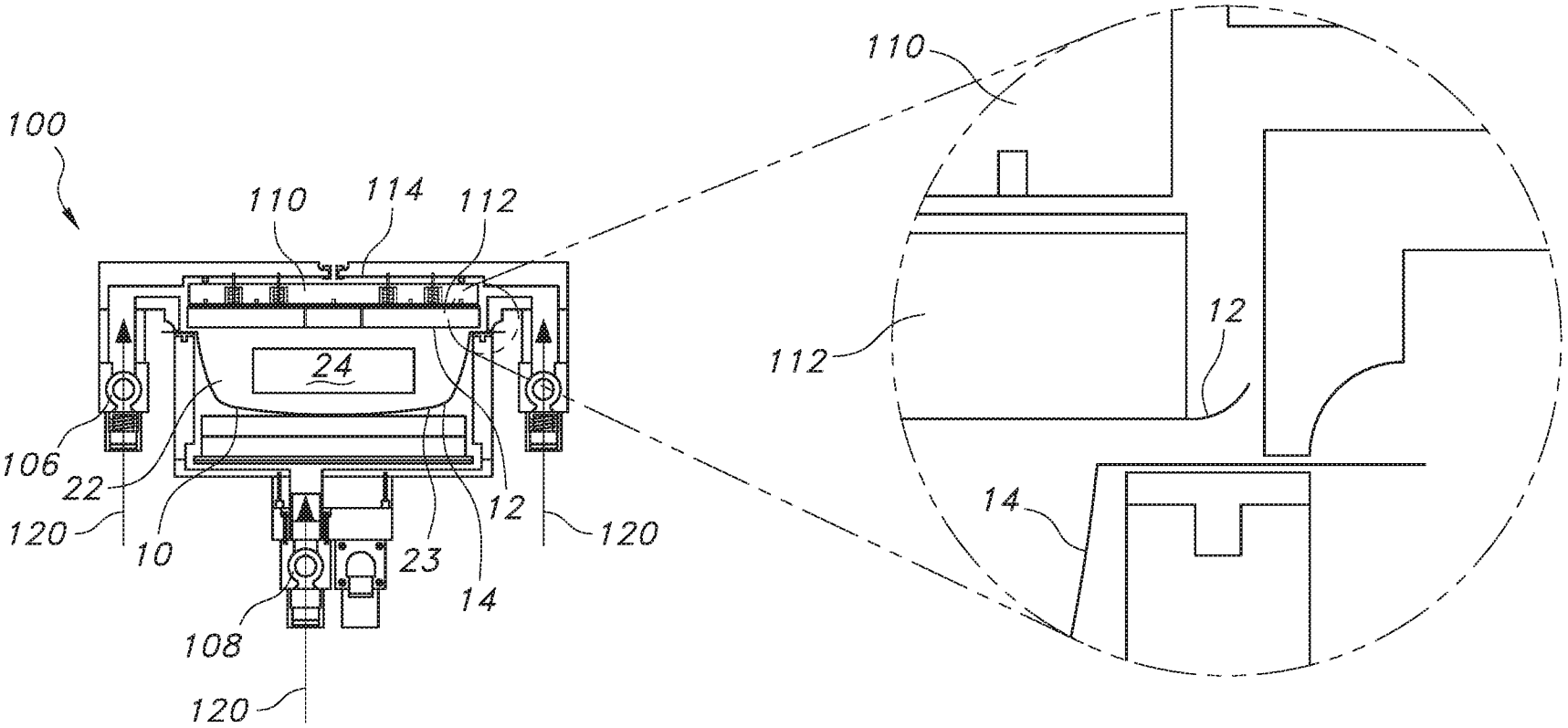
FIG. 4 is a cross-sectional view of a packaging apparatus used in the method of sealing a product inside a package according to one embodiment of the present invention, including a zoomed in view, before the package has been sealed and where the interior of the package is flushed with an inert gas.

Then, referring to FIG. 4, after the vacuum 118 is pulled, the interior 22 of the package 10 can be flushed with an inert gas 120 (e.g., nitrogen, argon, or any other inert gas, and/or a combination thereof). The inert gas flush 120 can be applied until a pressure equal to or less than about 750 millibars is achieved, such as between about 75 millibars and 525 millibars. In one embodiment, the inert gas flush 120 can be applied at a pressure ranging from about 400 millibars to about 600 millibars, such as about 500 millibars. In another embodiment, the inert gas flush can be applied at a pressure ranging from about 50 millibars to about 150 millibars, such as about 100 millibars. Such a flush with an inert gas 120 displaces any residual atmospheric gas from the interior 22 of the package 10, thereby further lowering the concentration of oxygen gas inside the package.

Figure 5:
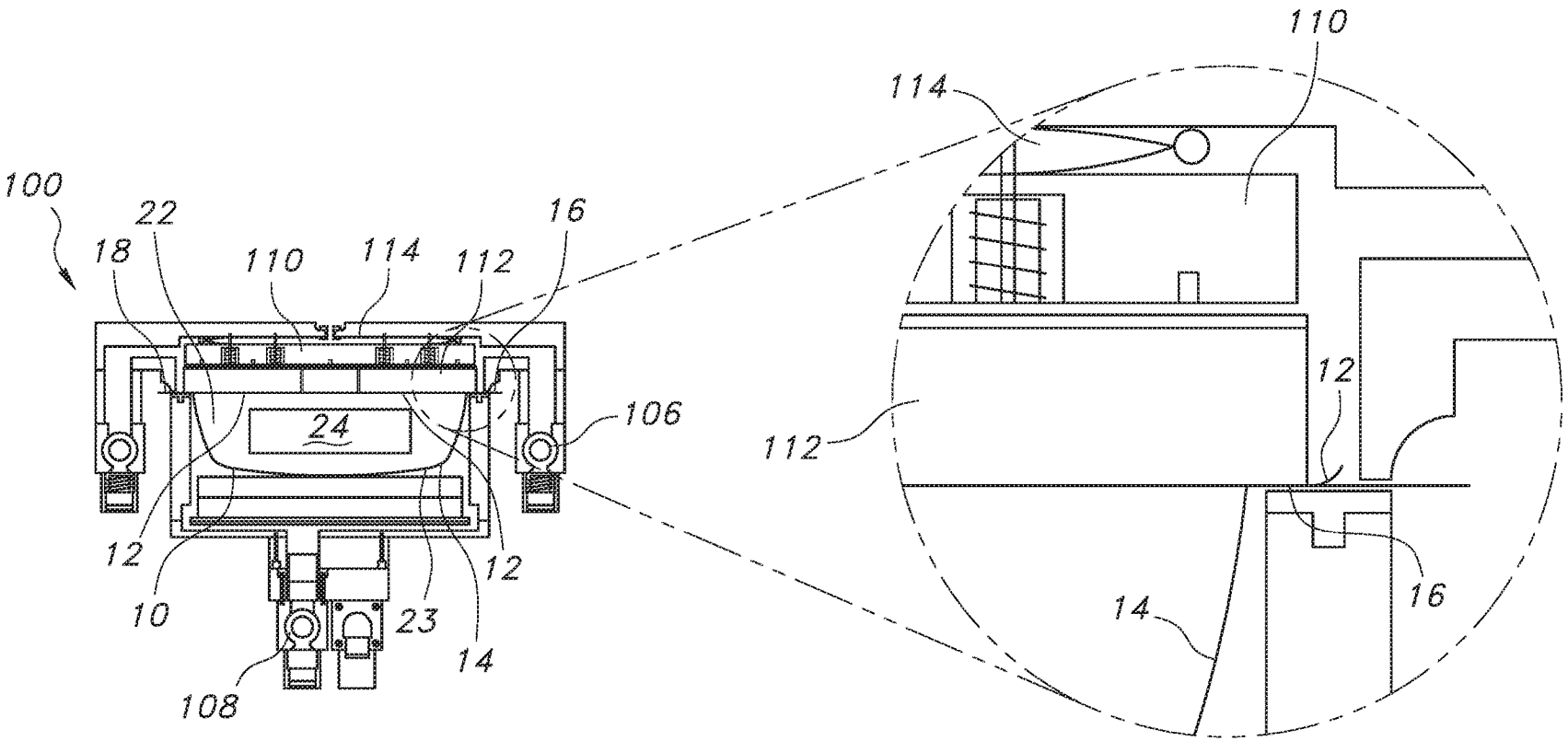
FIG. 5 is a cross-sectional view of a packaging apparatus used in the method of sealing a product inside a package according to one embodiment of the present invention, including a zoomed in view, while the package is being sealed under a controlled atmosphere.
Figure 6:
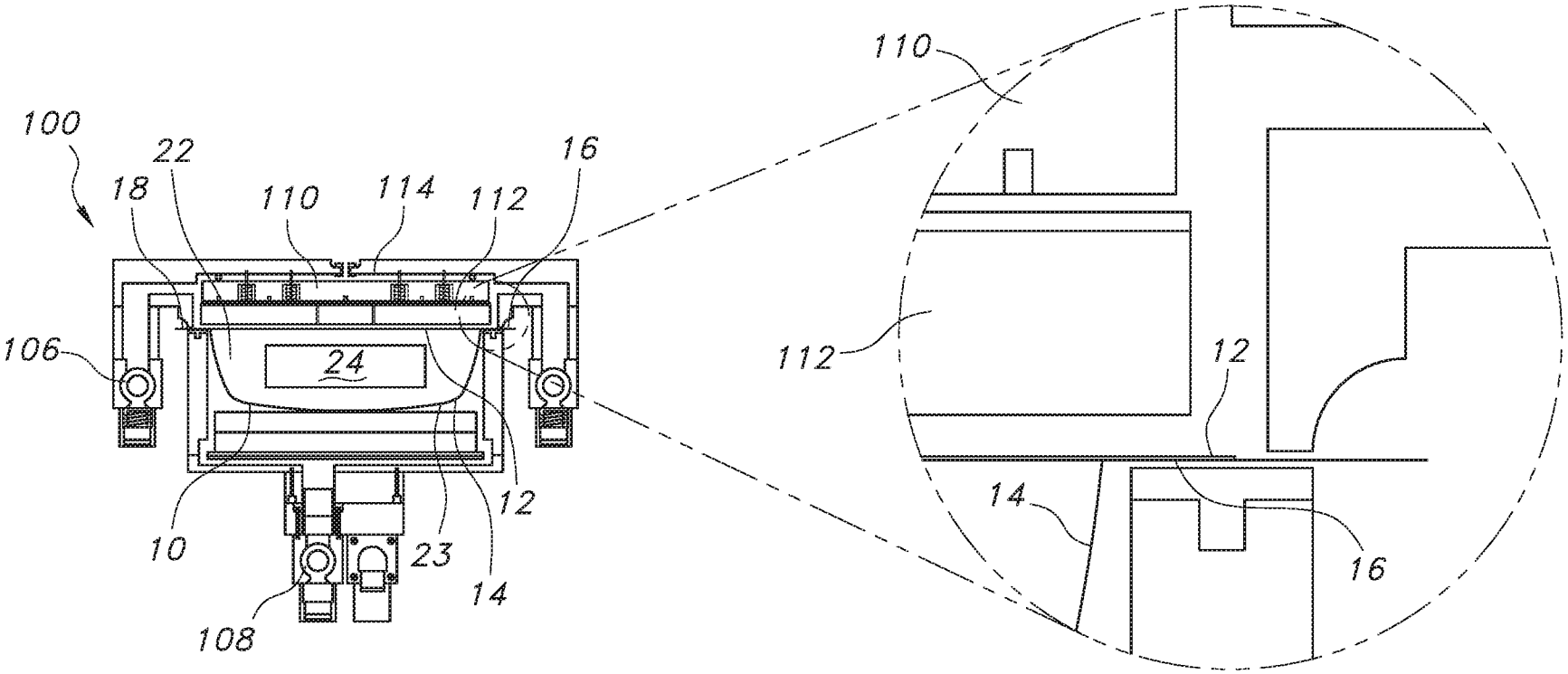
FIG. 6 is a cross-sectional view of a packaging apparatus used in the method of sealing a product inside a package according to one embodiment of the present invention, including a zoomed in view, after the package has been sealed under a controlled atmosphere.

After the inert gas flush 120 and turning now to FIGS. 5 and 6, the product 24 can be sealed in the package 10 in a controlled atmosphere using the sealing plate 112. As shown in FIG. 5, the sealing plate 112 presses down on the outer member 12, which then contacts the outer member 14 to create seal lines 16 and 18. A zoomed-in view of the seal line 16 is shown for completeness. After the seal lines 16 and 18 are formed under a controlled atmosphere due to the vacuum 118 and inert gas flush 120, the sealing plate 112 moves upward as shown in FIG. 6.

Figure 7:
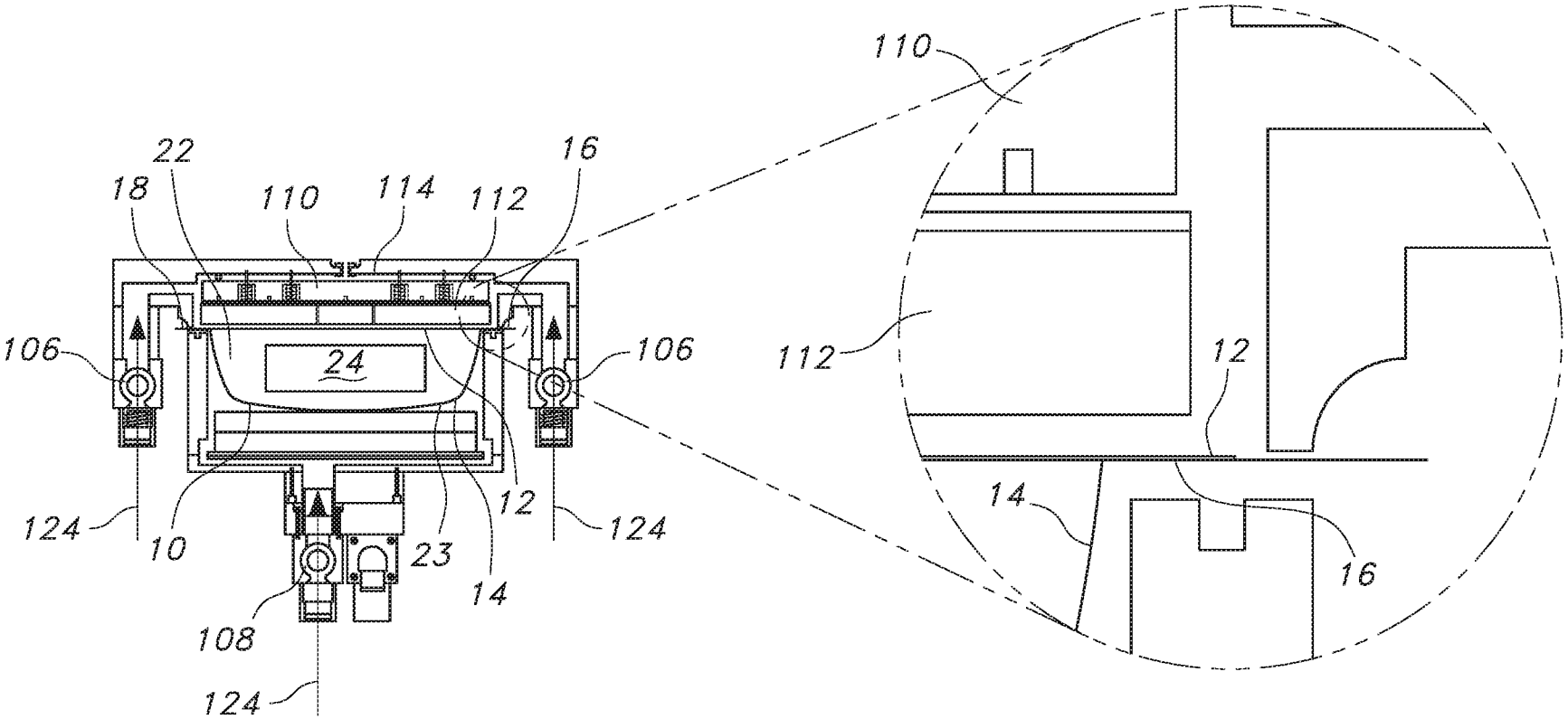
FIG. 7 is a cross-sectional view of a packaging apparatus used in the method of sealing a product inside a package according to one embodiment of the present invention, including a zoomed in view, after the package has been sealed under a controlled atmosphere, where the vacuum is released and the package is exposed to atmospheric conditions.
Figure 8:
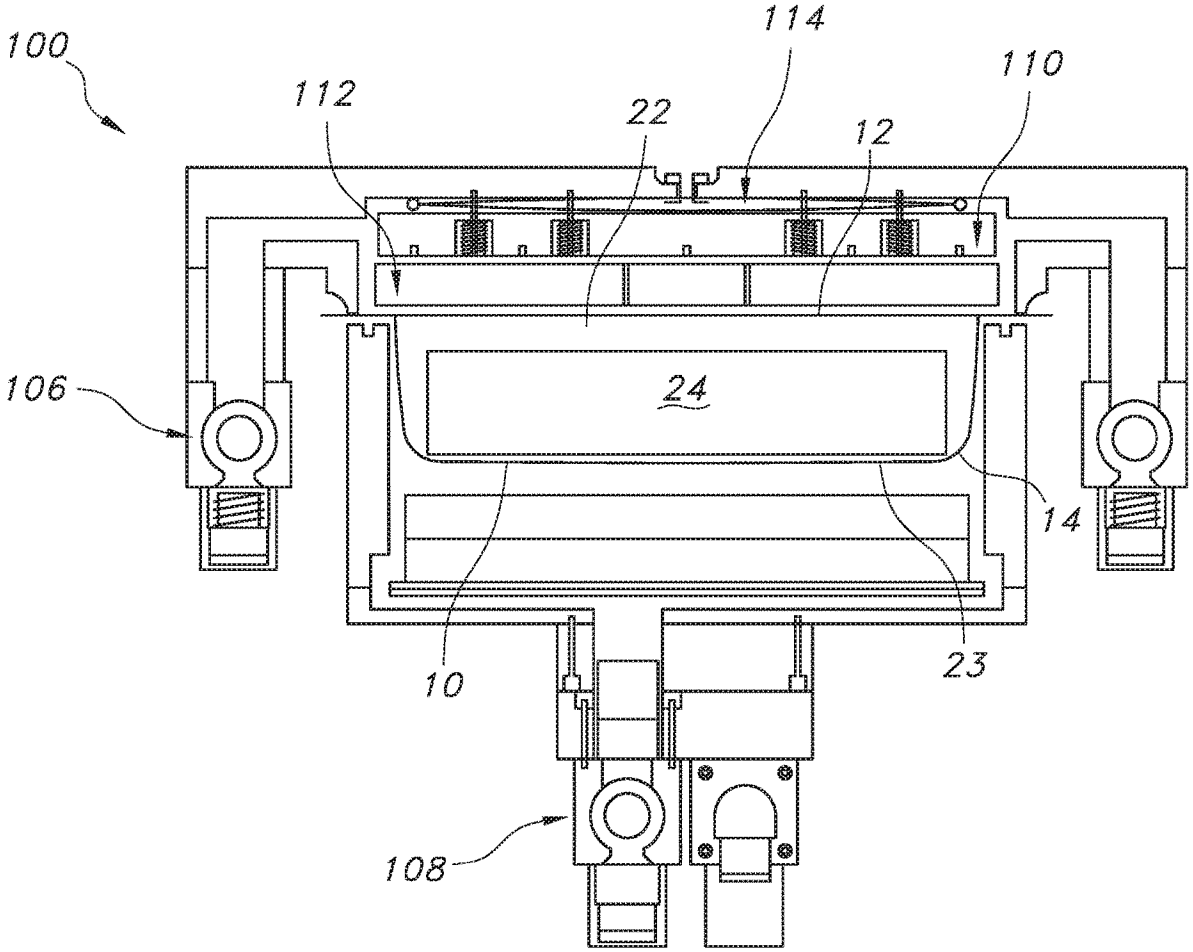
FIG. 8 is a cross-sectional view of a product sealed inside a package according to one embodiment of the present invention in a controlled atmosphere prior to evacuation.
Figure 9:
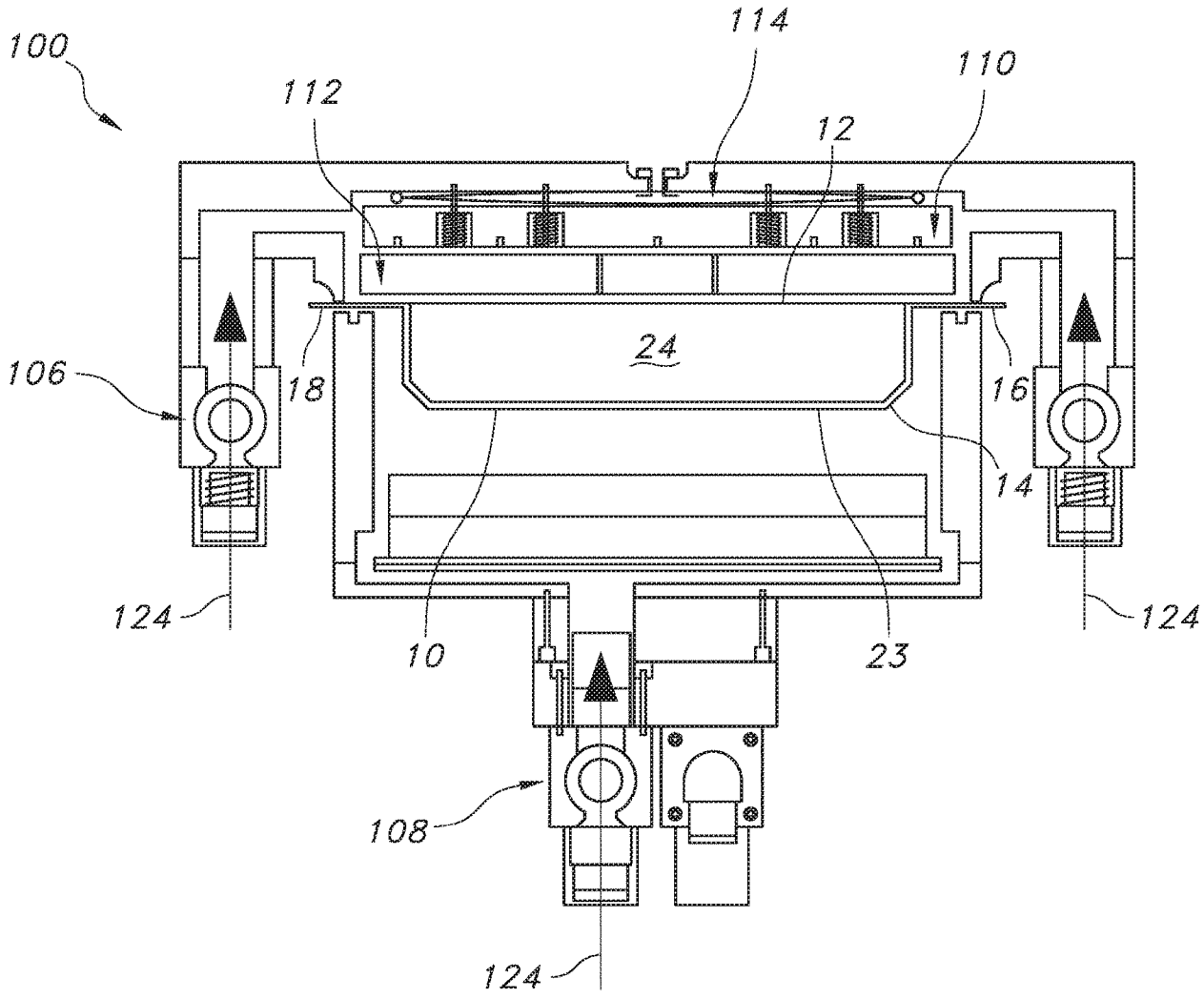
FIG. 9 is a cross-sectional view of a product sealed inside a package according to one embodiment of the present invention when exposed to atmospheric conditions after evacuation.

After the package 10 is sealed, as shown in FIG. 7, the vacuum that has been applied to the exterior 23 of the package 10 in the controlled atmosphere is released so that the package 10 and its contents are exposed to atmospheric pressure 124, which causes the package 10 to collapse due to the vacuum inside the package. FIGS. 8 and 9 show this process in more detail. Specifically, FIGS. 8 and 9 show the state of the package 10 and product 24 when sealed in a controlled atmosphere (FIG. 8) and in regular atmosphere (FIG. 9) after evacuation. As shown, in the regular atmosphere, the volume of the package 10 is reduced as the package 10 and product 24 have collapsed due to the atmospheric pressure being greater than the pressure inside the package 10. The step of releasing the vacuum applied to the exterior of the package in the controlled atmosphere may be controlled to generate a combination of package and product having a density at least 10% greater than an identical combination not treated with a vacuum and an inert gas flush. This results in a package 10 that having an increase in density (that is, a package that occupies less volume), such as at least about 20%, such as at least about 30%, such as at least about 40%, such as at least about 50%, greater than a package not treated with a vacuum and an inert gas flush. Generally speaking, the increase in density (reduction in volume) may range from at least about 10% up to about 75%. For example, the increase in density may range from about 20% up to about 60%.

According to an aspect of the invention, the step of releasing the vacuum applied to the exterior of the package may be controlled to generate a combination having a pre-determined shape and/or a pre-determined stiffness. For example, the the pre-determined shape desirably is substantially flat and planar. It is contemplated that the pre-determined shape may be curved and planar (e.g., such as a half annular portion or quarter annular portion of a hollow cylinder). It is also contemplated that the predetermined shape may be conical (e.g., such as a hollow cone). The pre-determined shape may be flat, planar having a bend or fold line to generate an acute, obtuse or right angle. These pre-determined shapes may be generated by utilizing a sealing plate 110 have a specific curved, conical or other geometric configuration such that the package has a corresponding shape. Alternatively and/or additionally, these pre-determined shapes may be introduced by post-treatment or processing.

The step of releasing the vacuum applied to the exterior of the package may be controlled to generate a combination having a pre-determined stiffness. The pre-determined stiffness is at least 10% greater than an identical combination not treated with a vacuum and an inert gas flush. This results in a package 10 that is stiffer, such as at least about 20%, such as at least about 30%, such as at least about 40%, such as at least about 50%, stiffer than a package not treated with a vacuum and an inert gas flush. Generally speaking, the increase in stiffness may range from at least about 10% up to about 75%. For example, the increase in stiffness may range from about 20% up to about 60%.

Once the product 24 has been sealed within the thermo-formed package 10 as discussed above with respect to FIGS. 2-9, the package 10 containing the product 24 can then be sterilized via any suitable form of ionizing radiation such as gamma irradiation, electron beam irradiation, or x-ray irradiation techniques. For instance, the product can be sterilized by gamma irradiation. Gamma irradiation techniques, for instance, are well-known in the art. For a general description of the gamma irradiation of polyolefin fibers see U.S. Pat. No. 5,041,483, which is herein incorporated by reference. Generally speaking, the amount of radiation necessary to sterilize the polyolefin product or gown is dependent upon the bioburden of the product. Additional factors include the density and configuration of the product to be sterilized. A likely range of irradiation is from about 10 kilogray to about 100 kilogray, such as from about 15 kilogray to about 60 kilogray, such as from about 25 kilogray to about 50 kilogray. In one particular embodiment, the dose of ionizing radiation can be less than or equal to 50 kGy.

Figure 10:
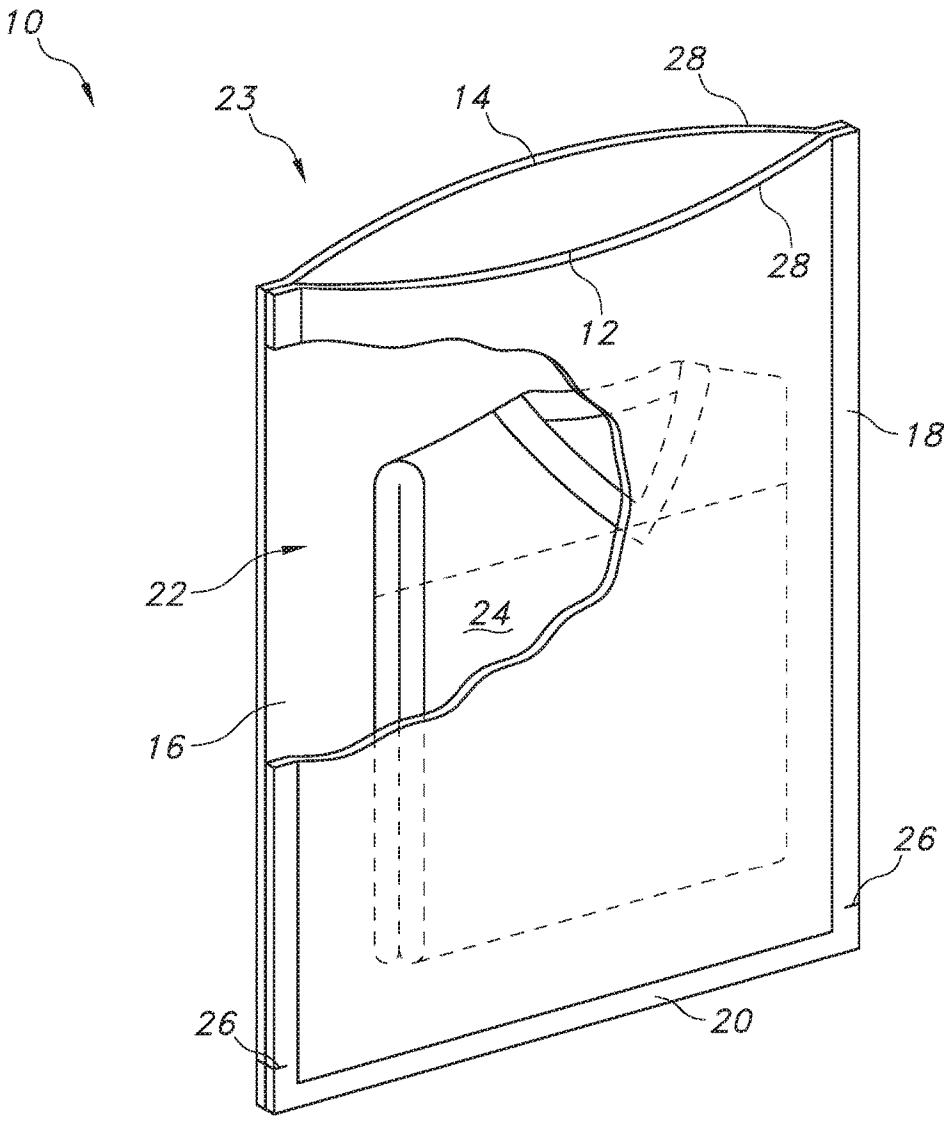
FIG. 10 illustrates a partially broken-away view of one embodiment of the packaged product of the present invention.

In one aspect of the present invention and turning now to FIG. 10, the product 24 and package 10 to be sterilized includes a product made of a nonwoven polypropylene material packaged in a package comprising outer members 12 and 14, where one or both outer members 12 and 14 can be formed from a film containing at least an ethylene vinyl alcohol layer or a nylon layer for sufficient oxygen impermeability, where the film has an oxygen transmission rate that is equal to or less than about 10 cubic centimeters of oxygen per 100 inches squared per 24 hours as described in more detail above. For instance, in some embodiments, one of the outer members 12 or 14 can include a polyethylene/nylon laminate, while the other of the outer members 12 or 14 can include a polyethylene terephthalate/polyethylene laminate or an ethylene/polyethylene laminate.

Figure 11:
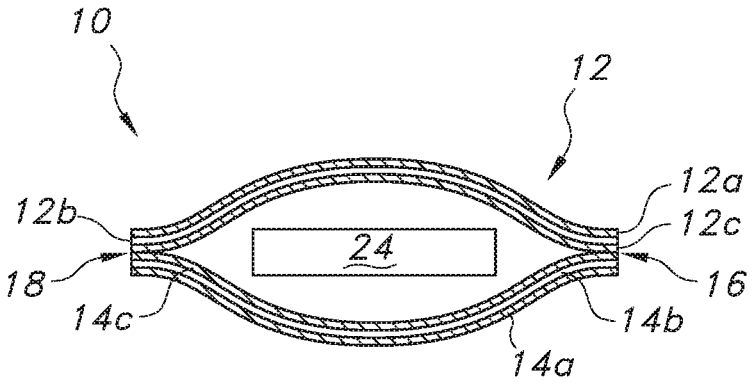
FIG. 11 is a cross-sectional view of FIG. 10 illustrating one embodiment of the components of outer members 12 and 14 contemplated by the present invention.
Figure 12:
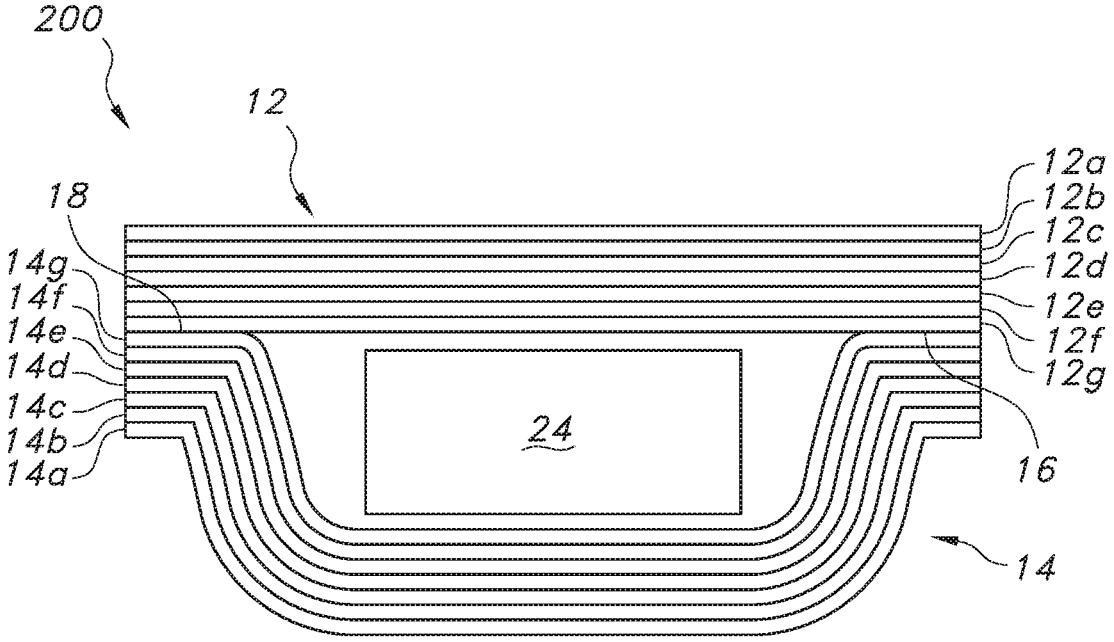
FIG. 12 is a cross-sectional view of FIG. 10 illustrating another embodiment of the components of outer members 12 and 14 contemplated by the present invention.
Figure 13:
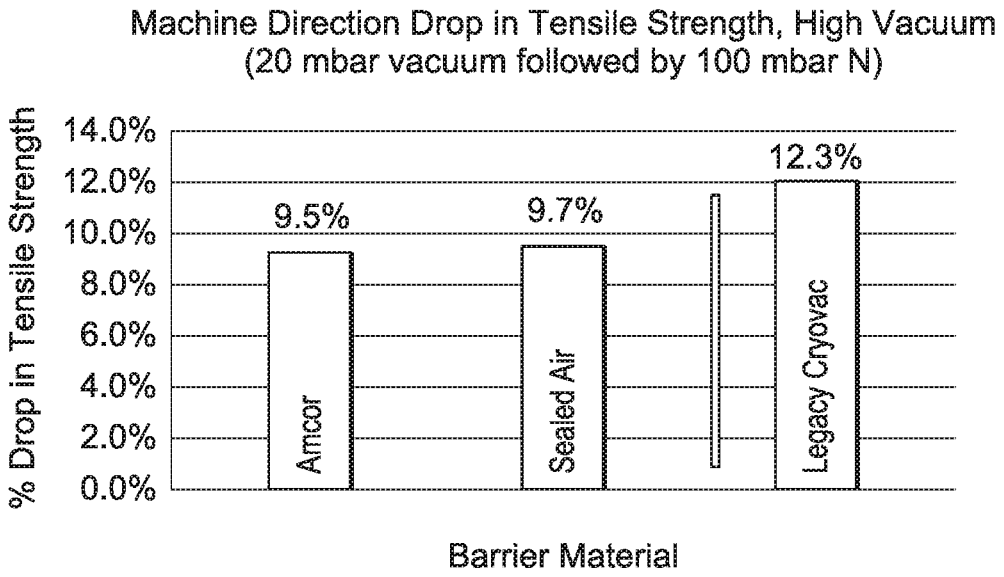
FIG. 13 is a bar graph showing the reduction in machine direction tensile strength of a nonwoven product sterilized in two different packaging materials that were subjected to a vacuum pressure of 20 millibars followed by a nitrogen gas flush at 100 millibars of pressure, after the product was sterilized with a 45 kilogray dose of gamma irradiation, as compared to a third packaging material subjected to a 45-50 kilogray dose of radiation with no nitrogen gas flush.
Figure 14:
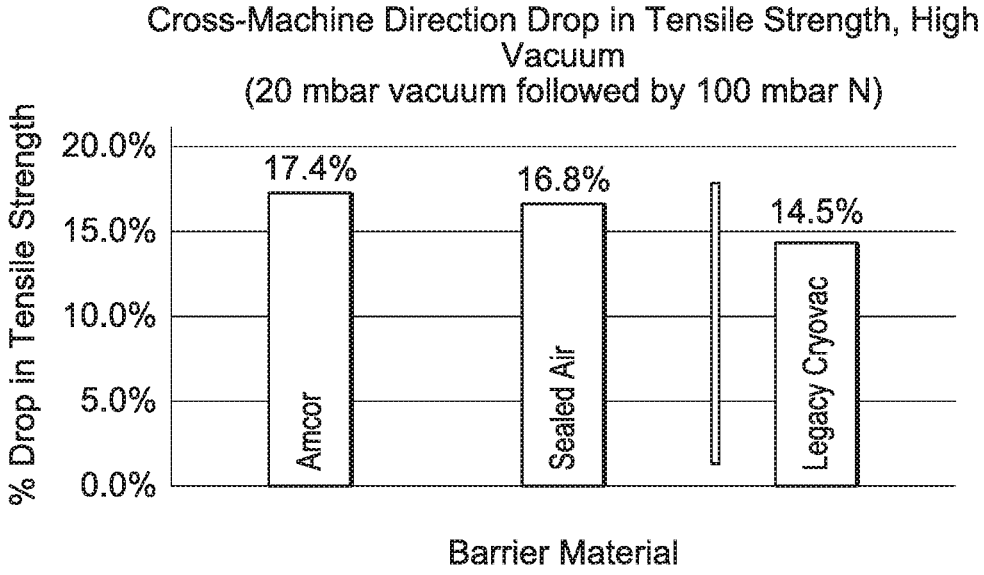
FIG. 14 is a bar graph showing the reduction in cross-machine direction tensile strength of a nonwoven product sterilized in two different packaging materials that were subjected to a vacuum pressure of 20 millibars followed by a nitrogen gas flush at 100 millibars of pressure, after the product was sterilized with a 45 kilogray dose of gamma irradiation, as compared to a third packaging material subjected to a 45-50 kilogray dose of radiation with no nitrogen gas flush.
Figure 15:
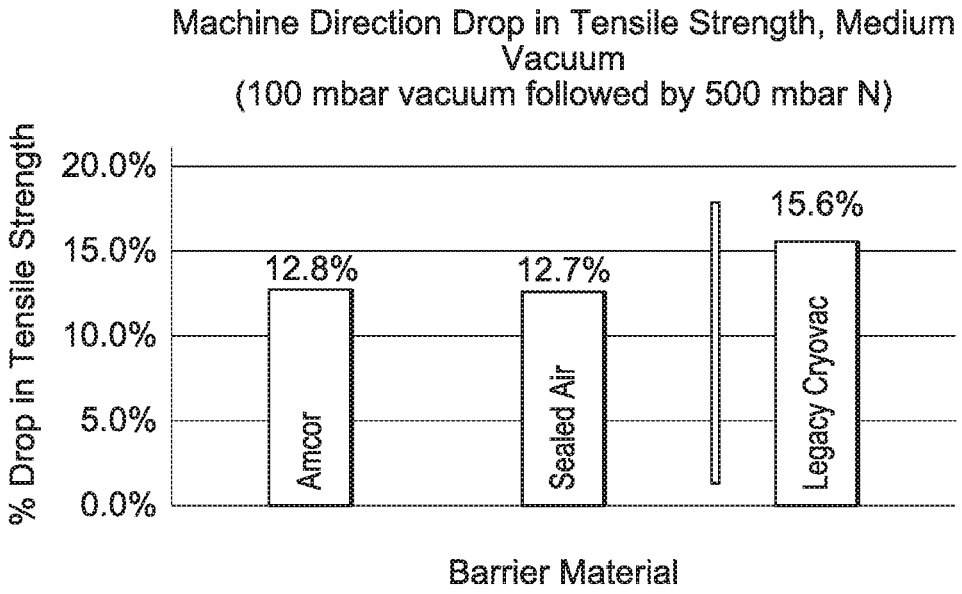
FIG. 15 is a bar graph showing the reduction in machine direction tensile strength of a nonwoven product sterilized in two different packaging materials that were subjected to a vacuum pressure of 100 millibars followed by a nitrogen gas flush at 500 millibars of pressure, after the product was sterilized with a 45-50 kilogray dose of gamma irradiation, as compared to a third packaging material subjected to a 50 kilogray dose of radiation with no nitrogen gas flush.
Figure 16:
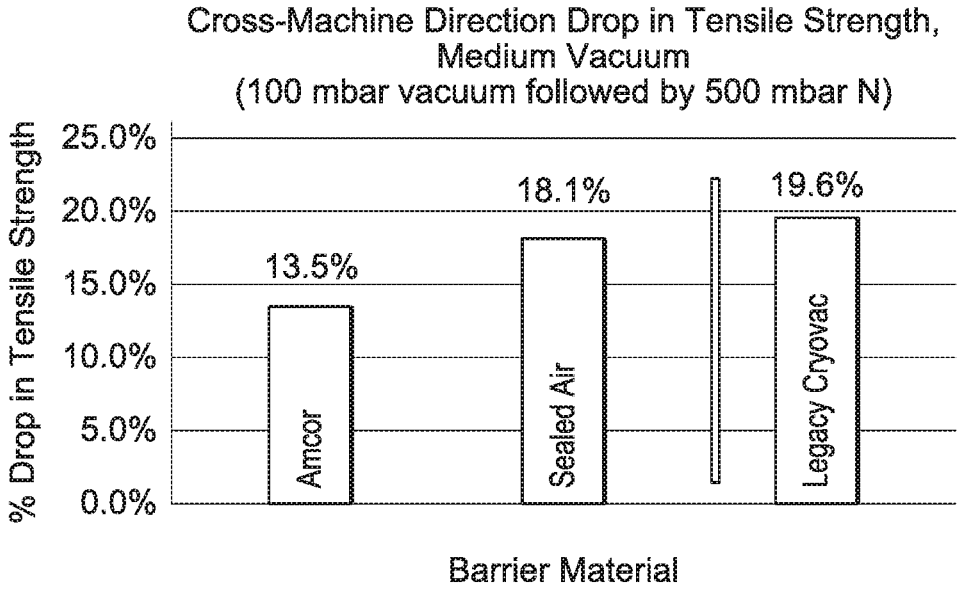
FIG. 16 is a bar graph showing the reduction in cross-machine direction tensile strength of a nonwoven product sterilized in three different packaging materials that were subjected to a vacuum pressure of 100 millibars followed by a nitrogen gas flush at 500 millibars of pressure, after the product was sterilized with a 45-50 kilogray dose of gamma irradiation, as compared to a third packaging material subjected to a 50 kilogray dose of radiation with no nitrogen gas flush.

The package 10 as contemplated by the present invention and formed by the methods described herein may be used for packaging individual or multiple products such as, by way of example only, surgical or other type gowns, gloves, masks, drapes, packs, covers, and the like. The package 10 has an exterior 23 and comprises outer members 12, 14 which are oxygen impermeable films that are sealed, for example, by means of heat seal lines 16, 18, and 20, thereby forming interior 22 in package 10. Members 12, 14 can be a single layer of material, or a laminate of more than one layer of the same or different material, and can include a layer for purposes of oxygen impermeability. For instance, referring to FIGS. 11 and 12, possible variations of members 12 and 14 are shown. Referring to FIG. 11, the package 10 can include outer members 12 and 14 that each include a 3-layer co-extruded film comprising an outermost layer of nylon 12*a* or 14*a*, an innermost layer (e.g., the sealant side layer) of polyethylene 12*c* or 14*c*, and an intermediate layer 12*b* or 14*b* of ethylene vinyl alcohol (EVOH), although any number and type of film layers can be used so long as a sufficient level of oxygen impermeability is achieved, such as via the use of one or more nylon-based or EVOH-based film layers, or one or more layers formed from any other suitable material having a low oxygen transmission rate. For instance, each outer member 12 and 14 can include 5, 7, 9 or more layers. Referring to FIG. 12, the package 200 can include outer members 12 and 14 that each includes a 7-layer coextruded film. For instance, the package 200 can include an outer most layer of linear low density polyethylene (LLDPE) 12*a* or 14*a*, an innermost layer (e.g., the sealant side layer) of LLDPE 12*g* or 14*g*, and a middle layer of polyethylene 12*d* or 14*d*. Then, working from the middle layer 12*d* or 14*d*, the interior layers 12*c*, 14*c*, 12*e*, and 14*e* can be nylon, while the interior layers 12*b*, 14*b*, 12*f*, and 14*f* can be polyethylene, although it is again to be understood that any suitable materials can be used to form the films of outer members 12 and 14 so long as a sufficient level of oxygen impermeability is achieved, such as via the use of one more nylon-based or EVOH-based film layers.

Meanwhile, product 24, which can be a nonwoven material such as a SMS polyolefin material, is placed in interior 22, and then package 10 is sealed along periphery 28. If desired, notches 26 may be cut in package 10 to facilitate product removal.

The materials and methods used in carrying out the present invention may be more fully understood by reference to the following examples, which examples are not intended in any manner to limit the scope of the present invention.

Example 1

The ability to reduce tensile strength loss of spunbond-meltblown-spunbond (SMS) polyolefin-based nonwoven fabrics was determined for various vacuum, inert gas (nitrogen) flush, and gamma irradiation conditions. Samples of SMS fabrics were sealed in thermoformed film-to-film packages using a thermoforming packaging machine as generally described above. The film-to-film packages included top and bottom layers, where the resulting packages had various oxygen transmission rates (OTR) as described below in Table 1.

TABLE 1

Film to Film Packaging Materials

| Top Film<br>Bottom (Forming) Film | Resulting Package OTR<br>($cm^3$/100 $in^2$/24 hours) |
|---|---|
| Cryovac ® T-7230BW<br>Cryovac ® T-7040EZ | 0.2 |
| Amcor FMP-521<br>Amcor 6 mil NXL | 1.5 |
| Sealed Air T-7250BW<br>Sealed Air T-7060B | 1.5 |

Individual packages of SMS fabric were created using a thermoforming packaging machine via a form-fill-seal process. Generally, the bottom layer of the package (outer member 14 as shown in FIGS. 2-9) was placed into a cavity (10"×8"×1.5") then thermoformed, followed by placing a single bundle of SMS fabric into the cavity, pressing the top layer (outer member 12 as shown in FIGS. 2-9) onto the bottom layer, pulling the desired level of vacuum, flushing the interior cavity with nitrogen, and thermally sealing the top layer to the bottom layer. The vacuum level reported is the level of vacuum pressure achieved during the initial evacuation of gas (e.g., oxygen) from the package, while the nitrogen gas level is the amount of pressure remaining in the package when it is sealed after the nitrogen gas flush and release of the vacuum applied to the exterior of the package. The control samples were then tested for tensile strength immediately, while the other samples were dosed with either 25-50 kilogray (kGy) of gamma irradiation prior to tensile testing.

Gamma irradiation was done for tight control (+/−10%) of the radiation dose. A target dose of 25, 45, or 50 kGy was used for the various samples as illustrated below in Table 3. For the manufacturing process used to generate these samples, 50 kGy is considered the worst case radiation exposure necessary to ensure a $10^{-6}$ sterility assurance level and was therefore chosen to illustrate the invention. Previous work has demonstrated a strong correlation between the radiation dose applied to polypropylene spunbond samples and the amount of tensile loss that occurs.

For all samples, the tensile testing was conducted following ASTM D-5034 test method entitled: "Standard Test Method for Breaking Strength and Elongation of Textile Fabrics (Grab Test)". Details of the testing method can be found below in Table 2.

TABLE 2

| ASTM D-5034 Testing Parameters | |
|---|---|
| Sample Size | 6" long × 4" wide |
| Crosshead Speed | 12 inches/minute |
| Gage Length | 3 inches |
| Load Units | grams-force |
| Full-Scale Load | Use an appropriate load cell for the material being tested so that the test value falls between 10 and 90% of the full-scale load. |
| Break Sensitivity | 40% |

For each sample listed below in Table 3, the samples were tested for tensile strength in both the machine direction and cross-machine direction. The control samples were then used to calculate the percent loss in tensile strength for the samples that were subjected to gamma irradiation.

The % loss in tensile strength in the machine direction or cross-machine direction due to gamma irradiation exposure was then calculated using the following formula:

$$\%\ \text{tensile loss} = \left(1 - \frac{\text{tensile strength post-radiation}}{\text{tensile strength pre-radiation}}\right) \times 100\%$$

The machine direction and cross-machine direction % tensile strength loss is shown for the various samples processed at various vacuum levels, nitrogen gas flush levels, and gamma irradiation exposure levels in packages formed from films with varying oxygen transmission rates (see Table 1) is shown in Table 3 below, and the 45 kilogray gamma irradiation exposure samples are also compared in the bar charts shown in FIGS. 13-16.

TABLE 3

Effects of Vacuum Level, Nitrogen Gas Flush, and Radiation Dose on Tensile Properties of SMS Polypropylene Exposed to Sterilizing Radiation Processing Conditions for Packaging and Sterilization of Spunbond-Meltblown-Spunbond Nonwoven Web Material For Tensile Testing

| Sample | Top Film / Bottom Film | Gamma Sterilization (kilogray) | Vacuum (mbar) | $N_2$ Gas (mbar) | Cycles/ Min | Cycle Time (s) | MD Tensile Strength (grams-force) | % Loss in MD Tensile Strength Post-Sterilization | CD Tensile Strength (grams-force) | % Loss in CD Tensile Strength Post-Sterilization |
|---|---|---|---|---|---|---|---|---|---|---|
| 1 | *Amcor FMP-521* / *Amcor 6 mil NXL* | 45 | 100 | 500 | 9.6 | 6.25 | 7891 | 12.8 | 5466 | 13.5 |
| 2 | *Amcor FMP-521* / *Amcor 6 mil NXL* | 25 | 100 | 500 | 9.6 | 6.25 | 8276 | 8.6 | 5474 | 13.3 |
| 3 | *Amcor FMP-521* / *Amcor 6 mil NXL* | 45 | 20 | 100 | 6.1 | 9.84 | 8197 | 9.5 | 5217 | 17.4 |
| 4 | *Amcor FMP-521* / *Amcor 6 mil NXL* | 25 | 20 | 100 | 6.1 | 9.84 | 8259 | 8.8 | 5793 | 8.3 |
| 5 | Amcor Foil | 45 | 20 | 100 | 6.1 | 9.84 | — | — | — | — |
| 6 | *Amcor FMP-521* / *Amcor 6 mil NXL* | 0 (Control) | 20 | 100 | 6.1 | 9.84 | 9054 | — | 6317 | — |
| 7 | Sealed Air *T7250BW* / Sealed Air *T 7060B* | 45 | 100 | 500 | 9.6 | 6.25 | 7902 | 12.7 | 5176 | 18.1 |
| 8 | Sealed Air *T7250BW* / Sealed Air *T 7060B* | 25 | 100 | 500 | 9.6 | 6.25 | 8255 | 8.8 | 5498 | 13.0 |
| 9 | Sealed Air *T7250BW* / Sealed Air *T 7060B* | 45 | 20 | 100 | 6.1 | 9.84 | 8174 | 9.7 | 5254 | 16.8 |
| 10 | Sealed Air *T7250BW* / Sealed Air *T 7060B* | 25 | 20 | 100 | 6.1 | 9.84 | 8617 | 4.8 | 5911 | 6.4 |
| 11 | Sealed Air *T7250BW* / Sealed Air *T 7060B* | 0 (Control) | 20 | 100 | 6.1 | 9.84 | 9054 | — | 6317 | — |
| 12 | Cryovac *T-7230BW* / Cryovac *T-7040EZ* | 50 | 100 | — | — | — | 7702 | 15.6 | 4336 | 19.6 |

TABLE 3-continued

Effects of Vacuum Level, Nitrogen Gas Flush, and Radiation Dose on Tensile Properties of SMS Polypropylene Exposed to Sterilizing Radiation Processing Conditions for Packaging and Sterilization of Spunbond-Meltblown-Spunbond Nonwoven Web Material For Tensile Testing

| Sample | Top Film / Bottom Film | Gamma Sterilization (kilogray) | Vacuum (mbar) | $N_2$ Gas (mbar) | Cycles/ Min | Cycle Time (s) | MD Tensile Strength (grams-force) | % Loss in MD Tensile Strength Post-Sterilization | CD Tensile Strength (grams-force) | % Loss in CD Tensile Strength Post-Sterilization |
|---|---|---|---|---|---|---|---|---|---|---|
| 13 | Cryovac *T*-7230*BW* / Cryovac *T*-7040*EZ* | 50 | 20 | — | — | — | 8010 | 12.3 | 4613 | 14.5 |
| 14 | Cryovac *T*-7230*BW* / Cryovac *T*-7040*EZ* | 0 (Control) | 20 | — | — | — | 9131 | — | 5393 | — |

Table 3 shows the effects of varying the initial vacuum level, the nitrogen gas flush pressure level, and the oxygen transmission rate of the packaging material on the loss in tensile strength of polyolefin-based SMS fabrics that have been exposed to gamma radiation ($\gamma_{dose}$=25, 45, or 50 kGy). Generally, the samples that included a nitrogen gas flush (samples 1-4 and 7-10), despite having an increased OTR of 1.5 cubic centimeters of oxygen per 100 inches squared per 24 hours, exhibited reduced loss in tensile strength compared to the samples that did not include a nitrogen gas flush (samples 12-13), which had an OTR of 0.2 cubic centimeters of oxygen per 100 inches squared per 24 hours. Thus, despite allowing increased oxygen transmission, the samples contemplated by the present invention that included a nitrogen gas flush generally maintained their tensile strength better than samples that allowed less oxygen transmission. Such a distinction is not trivial, as film layers that have an increased OTR are less expensive than those having a reduced OTR.

Specifically, samples 1-4 and 7-10 (nitrogen gas flush) exhibited a percent loss of tensile strength in the machine direction ranging from 9.5% to 12.8%, while samples 12 and 13 (no nitrogen gas flush) exhibited a percent loss of tensile strength in the machine direction ranging from 12.3% to 15.6%. Meanwhile, samples 1-4 and 7-10 (nitrogen gas flush) exhibited a percent loss of tensile strength in the cross-machine direction ranging from 13.5% to 18.1%, while samples 12 and 13 (no nitrogen gas flush) exhibited a percent loss of tensile strength in the cross-machine direction ranging from 14.5% to 19.6%. Moreover, when comparing the samples utilizing the same vacuum levels (either 20 millibars or 100 millibars), the samples with the nitrogen gas flush and higher OTR films performed better and showed less tensile strength loss in the machine direction. For example, at 20 millibars of vacuum, samples 3-4 and 9-10 only exhibited a percent loss of tensile strength in the machine direction ranging from 4.8% to 9.7%, while sample 13 exhibited a percent loss of tensile strength in the machine direction of 12.3%. In addition, at 100 millibars of vacuum, samples 1-2 and 7-8 only exhibited a percent loss of tensile strength in the machine direction ranging from 8.6% to 12.8%, while sample 12 exhibited a percent loss of tensile strength in the machine direction of 15.6%.

Turning now to FIGS. 13-16, a comparison of the percent tensile strength loss of products contemplated by the present invention stored in packaging having an OTR of 1.5 cubic centimeters of oxygen per 100 inches squared per 24 hours and a nitrogen gas flush with products stored in packaging having an OTR of 0.2 cubic centimeters of oxygen per 100 inches squared per 24 hours and not including a nitrogen gas flush after gamma sterilization exposure of 45-50 kilogray and various vacuum levels is shown for the machine direction and cross-machine direction. As shown, the Amcor and Sealed Air samples, which were sterilized in packaging having an OTR of 1.5 cubic centimeters of oxygen per 100 inches squared per 24 hours and a nitrogen gas flush, showed an improvement in tensile strength loss for the machine direction after processing with 20 millibars of vacuum and 100 millibars of nitrogen compared to the Legacy Cryovac samples, which were sterilized in packaging having an OTR of 0.2 cubic centimeters of oxygen per 100 inches squared per 24 hours and no nitrogen gas flush. Further, the Amcor and Sealed Air samples, which were sterilized in packaging having an OTR of 1.5 cubic centimeters of oxygen per 100 inches squared per 24 hours and a nitrogen gas flush, showed an improvement in tensile strength loss for the machine direction after processing with 100 millibars of vacuum and 500 millibars of nitrogen compared to the Legacy Cryovac samples, which were sterilized in packaging having an OTR of 0.2 cubic centimeters of oxygen per 100 inches squared per 24 hours and no nitrogen gas flush.

Example 2

Nonwoven materials (e.g., drapes, gowns) were placed in thermoformed film-to-film packages and then tested for oxygen content within the packages over a time period spanning 32 days. One of the goals of Example 2 was to determine if various packages met the barrier requirement goal of maintaining an oxygen-reduced environment inside the package for up to 5 years pre-sterilization. The various samples tested are shown below in Table 4. It should be noted that the sample packages were formed with either a draw depth of 45 mm unless otherwise noted.

TABLE 4

Film-to-Film Packages Tested for % Oxygen Over Time

| Sample | Top Layer | Bottom Layer | Sample Size |
|---|---|---|---|
| Combo 1 | Polyethylene Terephthalate/Polyethylene Laminate | 4 mil (101.6 micron) Nylon/Polyethylene Laminate (Moderate Barrier) | 3 |
| Combo 2 | Ethylene/Polyethylene Laminate | 4 mil (101.6 micron) Nylon/Polyethylene Laminate (Moderate Barrier) | 3 |
| Combo 3 | Ethylene/Polyethylene Laminate | 7 mil (177.8 micron) Nylon/Polyethylene Laminate (Moderate Barrier) | 3 |
| Combo 4 | Ethylene/Polyethylene Laminate | 5 mil (127 micron) Nylon/EVOH Laminate (High Barrier) | 3 |
| Combo 4 85 mm Draw | Ethylene/Polyethylene Laminate | 5 mil (127 micron) Nylon/EVOH Laminate (High Barrier) | 3 |
| Combo 4a | Ethylene/Polyethylene Laminate | 5 mil (127 micron) Nylon/EVOH Laminate (High Barrier) | 3 |
| Combo 5 | Ethylene/Polyethylene Laminate | 4 mil (101.6 micron) Nylon/EVOH Laminate (High Barrier) | 3 |
| Combo 6 | Ethylene/Polyethylene Laminate | 6 mil (152.4 micron) Nylon/EVOH Laminate (High Barrier) | 3 |

During the oxygen content study, an OpTech® oxygen reader from MOCON was used to read re-usable platinum sensors that were sealed into the bottom of the sealed package samples. The sensors enabled measurement of the % oxygen in each package over time. The oxygen content of the samples listed in Table 4 was measured at the time of package sealing (time 0) and over the course of the following 32 days. Testing was performed every 2 to 4 days early on, then once per week for the final two readings.

Figure 17:
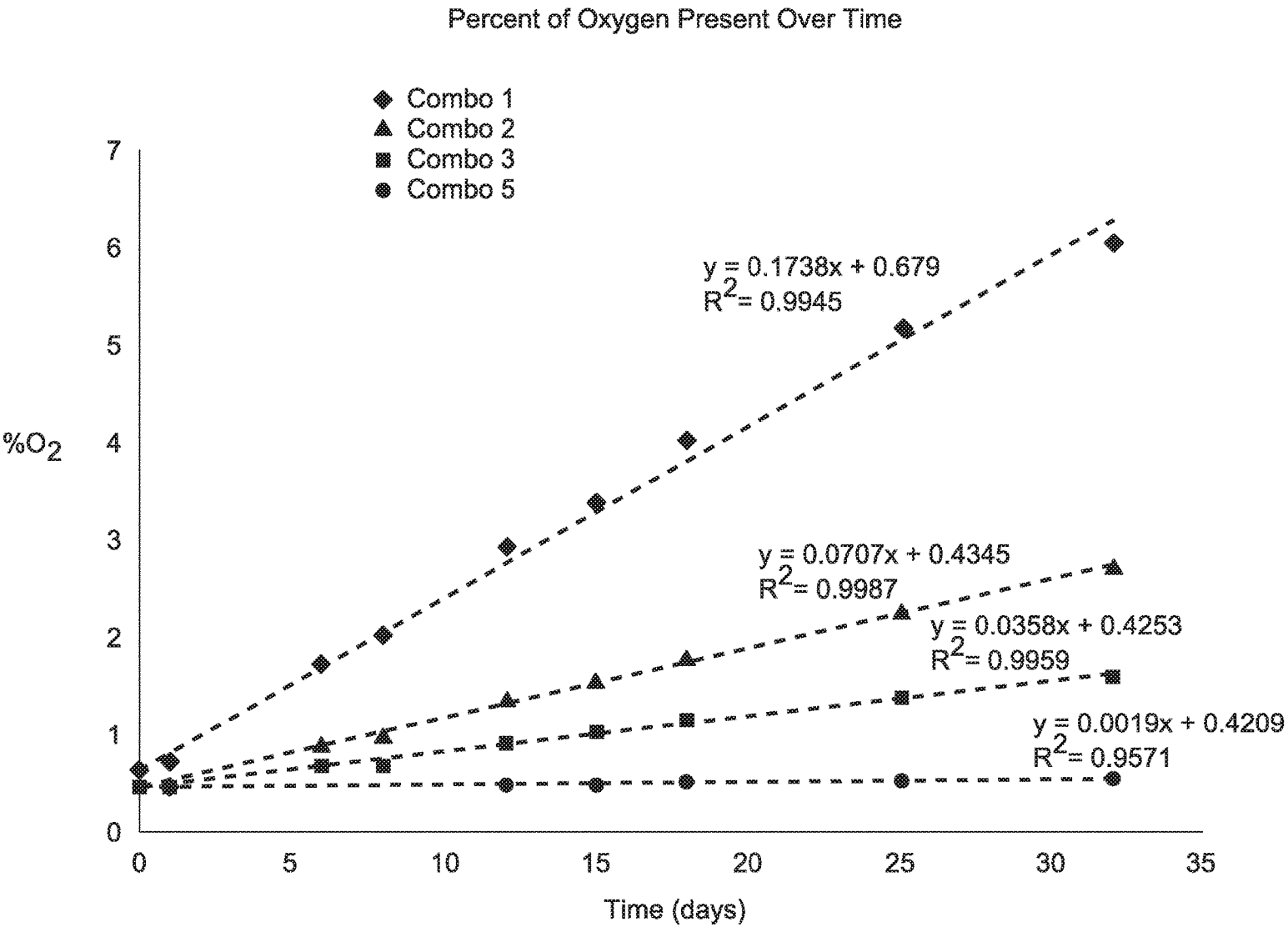
FIG. 17 is a graph showing the amount of oxygen present in various packaging materials over time, where the packaging materials were not yet subjected to sterilization and contained a nonwoven material in the interior of the packaging.
Figure 18:
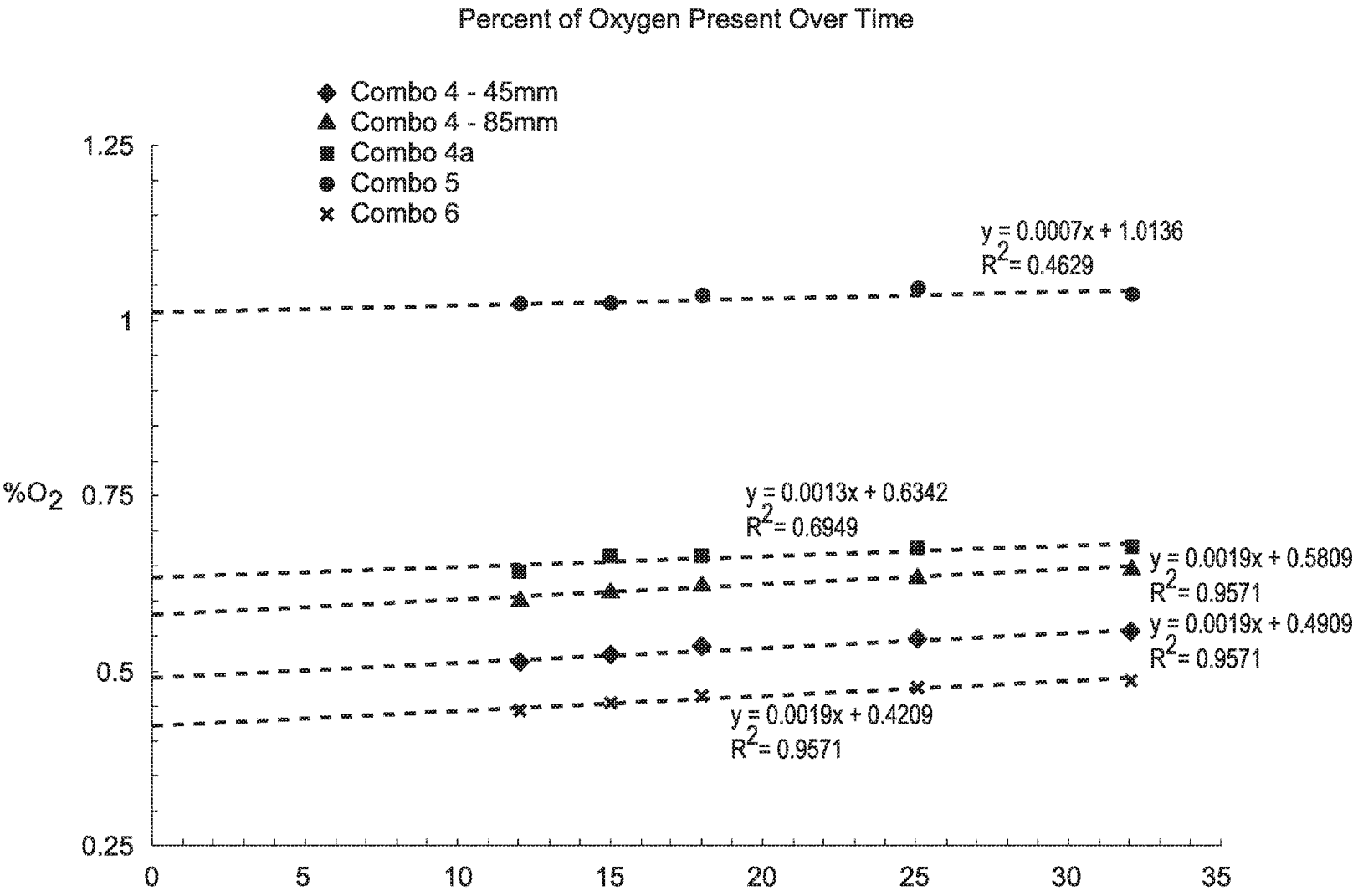
FIG. 18 is another graph showing the amount of oxygen present in various packaging materials over time, where the packaging materials were not yet subjected to sterilization and contained a nonwoven material in the interior of the packaging.

FIGS. 17 and 18 summarize the results for the % oxygen in each of the packages over the 32 day period. Specifically, FIG. 17 summarizes the % oxygen data for packages with a high oxygen transmission rate (moderate barrier) (combos 1-3) and one package with a lower oxygen transmission rate (high barrier) (combo 5), while FIG. 18 summarizes the % oxygen data for packages with a lower transmission rate (high barrier) (combos 4-6). Combo 5 is also plotted in FIG. 18 as a point of reference between FIGS. 17 and 18.

FIGS. 17 and 18 show a linear trend line for each sample, along with the corresponding linear equation and $R^2$ value. The overall package barrier can be obtained from the slope of the line, and the starting oxygen concentration can be estimated for the intercept. For instance, for combo 1, the initial package oxygen concentration after forming, gas flushing, and sealing was about 0.68% and the package oxygen transmission rate is about 0.17% per day. It should be noted that as the % oxygen increases within a package, the slope of each curve starts to decreases, as evidenced in FIG. 17 with combo 1. This change in slope is due to the fact that the relative difference in partial pressure of oxygen between the inside and outside of the package is decreasing over time, leading to a decrease in driving force.

Based on the results shown in FIGS. 17-18 and the equation below, which can be derived from the Ideal Gas Law where PV=nRT, the partial pressure of oxygen in a package (P(t)) as a function of time can be estimated:

$$P(t)=P_d+(P_i-P_d)e^{(RT(TR')t)/V}$$

where $P_d$=driving force partial pressure (%), $P_i$=initial partial pressure in the package (%), R=gas constant, T=temperature, TR'=measured oxygen transmission rate at 100% oxygen, V=headspace volume, and t=time.

For these calculations, a headspace volume of 10 cubic centimeters was assumed. Also, for the packages using the low oxygen transmission rate barrier (high barrier) (combos 4-6), the average slope of 0.0016% of the oxygen transmission rate/day was used (average slope of data for combos 4-6). Based on these assumptions, combo 1 would be expected to equilibrate at 21% oxygen in less than 100 days, combo 2 would be expected to equilibrate at 21% oxygen in about 220 days, combo 3 would be expected to equilibrate at 21% oxygen in about 415 days, and combos 4-6 would only reach 4-6% oxygen in 5 years, and would require over 50 years to equilibrate at 21% oxygen.

In conclusion, Example 2 shows that a thermoformed film-to-film package can be produced that serves as a barrier to increased oxygen levels over time, which increases the stability of the package and also limits the volume or size of the package, while also maintaining the package in a rigid state, which can enable for efficient shipping and storage of packages formed as described in the present disclosure. In addition, the low oxygen content over a period of 5 years or greater can prolong the time during which packaged products can be stored with reduced odor upon sterilization, as any ingress of oxygen between the time of packaging and the time of sterilization can produce a strong odor upon sterilization of the package.

Example 3

In Example 3, thermoformed film-to-film packages containing a product (e.g., surgical gowns) made according to the methods of the present disclosure were provided to 80 study participants. In the study, 100% of the participants found the aseptic donning of the surgical gown to be acceptable. In addition, a majority of the participants found the packaging with respect to donning to be the same as, a little better, or much better than their current packaging and would accept the packages for use at their facility. Further, no comments were received with respect to any odor being emitted from the opened packages. Moreover, it was noted that the vacuum packaging of the present invention, which had a thickness half that of the comparison packaging, was preferred by some participants because it gave the added confidence of knowing if the packaged had been breached and was therefore unsterile. In addition, the participants perceived the thermoformed film-to-film packaging concepts as beneficial to their facilities in terms of storage and logistics management.

As mentioned above, as a result of the particular film-to-film packaging and packaging/sterilization conditions contemplated by the present invention, a nonwoven material such as a sterile drape, gown, etc. can exhibit various improved properties such as minimal tensile strength loss, reduced odor after sterilization, etc. In addition, because of the use of film-to-film packaging in conjunction with a vacuum for packaging the products of the present invention, the film-to-film packaging can fit the shape of folded drapes, gowns, etc. such that the packaging can collapse uniformly, thus avoiding the formation of crinkles, bends, and folds, which, in turn, provides for a package having a flat, planar shape. Because the packaging has a flat, planar shape, the combination of the packaging and product stored therein can be shipped and stored more efficiently, as the flat, planar shape is relatively stiff and occupies much less volume than conventionally packaged products and/or has greater stability. Accordingly, the present invention encompasses a system for shipping a quantity of folded drapes, gowns, etc. that includes: (i) a shipping container such as, for example, a shipping carton; and (ii) a plurality of packaged products arranged in the shipping container such that the plurality of packaged products occupies less volume, such as at least about 20%, such as at least about 30%, such as at least about 40%, such as at least about 50%, less volume than an identical plurality of package not treated with a vacuum and an inert gas flush (for example, from about 10% up to about 75% less volume; as another example, from about 20% up to about 60% less volume). The above described system for shipping such products also encompasses a system for stacking, storing and/or dispensing such packaged products (folded drapes, gowns, etc.) that includes a plurality of the packaged products arranged in a stack or arranged in a storage and/or dispensing container—particularly when the packaged products have a pre-determined shape and/or pre-determined stiffness at least 10% greater than an identical packaged product not treated with a vacuum and an inert gas flush. This results in a package that is stiffer, such as at least about 20%, such as at least about 30%, such as at least about 40%, such as at least about 50%, stiffer than a package not treated with a vacuum and an inert gas flush. Generally speaking, the increase in stiffness may range from at least about 10% up to about 75%. For example, the increase in stiffness may range from about 20% up to about 60%. Such stiffer products are more stable in a stack (e.g., for storage) or are more stable in a shipping container or dispensing container. Such stiffer products desirably have a pre-determined shape that is substantially flat and planar—which is generally thought to increase stability in a stack, in a storage container or dispensing container. It is contemplated that the pre-determined shape may be curved and planar (e.g., such as a half annular portion or quarter annular portion of a hollow cylinder). It is also contemplated that the predetermined shape may be conical (e.g., such as a hollow cone). The pre-determined shape may be flat, planar having a bend or fold line to generate an acute, obtuse or right angle. These alternative shapes may also impart stability and/or ease of dispensing.

Such a shape also enables the packaged product to be stacked with more stability (for example, in a sterilizer, as part of a kit and/or on a procedure tray) and the flat, stiff nature of the package product can also make it easier to open the package. Moreover, the collapsed package can function as a breach indicator to alert a user that the product contained therein is not sterile because the collapsed package will inflate if there is a breach and may also make an inflation noise under certain conditions to alert the user that sterility has been breached.

Moreover, the present invention allows for control of the volume of the inert gas flush to be controlled to provide for different amounts of compression or collapse of the packaged product in order to address the level of rebound encountered when the package is opened, as some drapes or gowns can "fluff up" when the package is opened.

These and other modifications and variations of the present invention may be practiced by those of ordinary skill in the art, without departing from the spirit and scope of the present invention. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims.

What is claimed is:

1. A combination of a product and a film-to-film package, wherein the product is vacuum packaged in the film-to-film package, wherein the product comprises a nonwoven polyolefin material, wherein the film-to-film package has an interior and an exterior and comprises a layer having an oxygen transmission rate than between 1.5 cubic centimeters of oxygen per 100 inches squared per 24 hours and 10 cubic centimeters of oxygen per 100 inches squared per 24 hours, wherein the product is located in the interior of the film-to-film package, wherein air is removed from the interior of the film-to-film package by applying a vacuum pressure between 20 millibars and 100 millibars to the exterior of the film-to-film package and then flushing the interior of the film-to-film package with an inert gas until the interior of the film-to-film package reaches an inert gas flush pressure between 100 millibars and 500 millibars, wherein the film-to-film package and the product are sterilized by ionizing radiation, and wherein the product exhibits a reduction in its tensile strength in a machine direction that is less than 13% after sterilization.

2. The combination of claim 1, wherein the film-to-film package is thermoformed, and wherein the ionizing radiation is gamma irradiation, electron beam irradiation, or x-ray irradiation.

3. The combination of claim 1, wherein the layer comprises ethylene vinyl alcohol or nylon.

4. The combination of claim 1, wherein the layer has an oxygen transmission rate between 1.5 cubic centimeters of oxygen per 100 inches squared per 24 hours and 5.0 cubic centimeters of oxygen per 100 inches squared per 24 hours.

5. The combination of claim 4, wherein the layer has an oxygen transmission rate between 1.5 cubic centimeters of oxygen per 100 inches squared per 24 hours and 2.0 cubic centimeters of oxygen per 100 inches squared per 24 hours.

6. The combination of claim 1, wherein the inert gas comprises nitrogen, argon, or a combination thereof.

7. The combination of claim 1, wherein the film-to-film package occupies less volume than a package not treated with a vacuum and an inert gas flush, and wherein the combination has a density at least 10 percent greater than that of an identical combination not treated with a vacuum and an inert gas flush.

8. The combination of claim 7, wherein the combination has a pre-determined shape and/or a pre-determined stiffness.

9. The combination of claim 8, wherein the pre-determined shape is planar, and/or wherein the pre-determined stiffness is at least 10 percent greater than that of the identical combination not treated with the vacuum and the inert gas flush.

10. A shipping system comprising: a shipping container and a plurality of a combination according to claim 1.

11. A dispensing system comprising: a dispensing container and a plurality of a combination according to claim 1.

12. A stack comprising two or more of a combination according to claim 1.

13. A method of packaging a product in a package, the method comprising the steps of:

providing a film-to-film package comprising a layer having an oxygen transmission rate between 1.5 cubic centimeters of oxygen per 100 inches squared per 24 hours and 10 cubic centimeters of oxygen per 100 inches squared per 24 hours, and having an interior and an exterior;

providing a product in the interior of the film-to-film package, wherein the product comprises a nonwoven polyolefin material;

applying a vacuum to the exterior of the package in a controlled atmosphere until a vacuum pressure between 20 millibars and 100 millibars is achieved;

flushing the interior of the film-to-film package with an inert gas until an inert gas flush pressure between 100 millibars and 500 millibars is achieved;

sealing the film-to-film package;

releasing the vacuum applied to the exterior of the package in the controlled atmosphere; and sterilizing the package and the product with ionizing radiation resulting in the product having a reduction in its tensile strength in a machine direction that is less than 13% after sterilization.

14. The method of claim 13, wherein the film-to-film package is thermoformed, and wherein the ionizing radiation is gamma irradiation, electron beam irradiation, or x-ray irradiation.

15. The method of claim 13, wherein the layer comprises ethylene vinyl alcohol or nylon.

16. The method of claim 13, wherein the layer has an oxygen transmission rate between 1.5 cubic centimeters of oxygen per 100 inches squared per 24 hours and 5.0 cubic centimeters of oxygen per 100 inches squared per 24 hours.

17. The method of claim 16, wherein the layer has an oxygen transmission rate between 1.5 cubic centimeters of oxygen per 100 inches squared per 24 hours and 2.0 cubic centimeters of oxygen per 100 inches squared per 24 hours.

18. The method of claim 13, wherein the inert gas comprises nitrogen, argon, or a combination thereof.

19. The method of claim 13, wherein the film-to-film package occupies less volume than a package not treated with a vacuum and an inert gas flush, and wherein the step of releasing the vacuum applied to the exterior of the package in the controlled atmosphere generates a combination of the package and the product having a density at least 10 percent greater than that of an identical combination not treated with a vacuum and an inert gas flush.

20. The method of claim 13, wherein the step of releasing the vacuum applied to the exterior of the package generates a combination having a pre-determined shape and/or a pre-determined stiffness.

21. The method of claim 20, wherein the pre-determined shape is planar, and/or wherein the pre-determined stiffness is at least 10 percent greater than that of an identical combination not treated with a vacuum and an inert gas flush.

* * * * *